US007082651B2

(12) United States Patent
Ninomiya

(10) Patent No.: US 7,082,651 B2
(45) Date of Patent: Aug. 1, 2006

(54) CLASP FOR JEWELRY

(75) Inventor: Tomoyasu Ninomiya, Tokyo (JP)

(73) Assignee: Seberu Pico Co., Ltd., Tokyo (JP)

( * ) Notice: Subject to any disclaimer, the term of this patent is extended or adjusted under 35 U.S.C. 154(b) by 0 days.

(21) Appl. No.: 11/061,454

(22) Filed: Feb. 22, 2005

(65) Prior Publication Data

US 2005/0183249 A1 Aug. 25, 2005

(30) Foreign Application Priority Data

Feb. 23, 2004 (JP) ..... 2004-046777
Feb. 23, 2004 (JP) ..... 2004-046778

(51) Int. Cl.
*A44B 11/26* (2006.01)
*A44B 21/00* (2006.01)

(52) U.S. Cl. ..... 24/658; 24/616; 24/633; 63/35

(58) Field of Classification Search ..... 24/658, 24/587.11, 574.1, 640, 665, 666, 634, 633, 24/664, 616; 63/35; A44B 11/26
See application file for complete search history.

(56) References Cited

U.S. PATENT DOCUMENTS 2,629,156 A * 2/1953 Kamens et al. ..... 24/657
3,413,692 A * 12/1968 Pressley ..... 24/602
4,945,617 A * 8/1990 Griffith ..... 24/633
5,722,260 A * 3/1998 Mangano ..... 63/3.1
5,894,641 A * 4/1999 Hurtz et al. ..... 24/658
6,145,171 A * 11/2000 Hoshino ..... 24/587.1
6,343,824 B1 * 2/2002 Foy ..... 294/82.35
6,484,376 B1 * 11/2002 Khatchadourian et al. .... 24/658
6,508,080 B1 * 1/2003 Ninomiya ..... 63/3.1

FOREIGN PATENT DOCUMENTS

JP 8-89320 4/1996
JP 08089320 A * 4/1996

* cited by examiner

*Primary Examiner*—Robert J. Sandy
*Assistant Examiner*—Marcus Menezes
(74) *Attorney, Agent, or Firm*—McGinn IP Law Group, PLLC

(57) ABSTRACT

A clasp for jewelry includes a body, a pin insertable into the body, a stopper engaging to the pin having been inserted into the body to keep the pin engaged to the body, and a releaser releasing the pin from the body. The releaser and the stopper are arranged to the body through a single part disposed in the body.

18 Claims, 13 Drawing Sheets

400

CLASP FOR JEWELRY

BACKGROUND OF THE INVENTION

1. Field of the Invention

The invention relates to a clasp used for jewelry.

2. Description of the Related Art

The clasp suggested in Japanese Patent Application Publication No. 8-89320 is comprised of a body having a connection ring, a pin to be inserted into the body, a stopper engaged to the pin to thereby prevent the pin from releasing from the body, and a releaser for ceasing engagement of the stopper with the pin.

The releaser and the stopper are formed integrally with each other. The releaser and the stopper are inserted into a hole formed with the body such that the releaser and the stopper are energized by a spring having been inserted into the hole. Then, the hole is sealed at its opening end to prevent the releaser, the stopper and the spring from dropping out of the hole.

The releaser projects beyond the body. The body is formed a through-hole extending perpendicularly to the above-mentioned hole so as to intersect with the hole in the body.

The pin is formed with grooves to which the stopper is to be engaged.

Inserting the pin into the through-hole, the stopper is engaged to one of the grooves at an intersection of the hole and the through-hole. Since the stopper is compressed by the spring, the pin is prevented from releasing from the body.

The releaser is pushed into the body against the spring to thereby release the stopper from the pin, and thus, a user can draw the pin out of the body.

In the above-mentioned conventional clasp, the releaser and the stopper are caulked to the body at a surface. Accordingly, the above-mentioned conventional clasp is accompanied with problems that (a) though the body is required to be ornamental at a surface thereof, the caulk degrades appearance of the body, (b) though the body is required to be ornamental at a surface thereof, the body may be scratched when the releaser and the stopper are caulked to the body, and (c) the fixation of the releaser and the stopper to the body need a skilled person and much time.

SUMMARY OF THE INVENTION

In view of the above-mentioned problems in the conventional clasps, it is an object of the present invention to provide a clasp which is capable of readily attaching a releaser and a stopper to a body without degradation in appearance of the clasp.

There is provided a clasp for jewelry, including a body, a pin insertable into the body, a stopper engaging to the pin having been inserted into the body to keep the pin engaged to the body, and a releaser releasing the pin from the body, wherein the releaser and the stopper are arranged to the body through a single part disposed in the body.

It is preferable that the pin is formed with at least one groove through which the stopper is engaged to the pin.

It is preferable that the releaser and the stopper are detachably arranged to the body through the single part.

The clasp may further include a cylinder to which the stopper and the releaser are integrally formed, the cylinder being movable relative to the body.

It is preferable that the single part passes through the cylinder, with the cylinder being inserted into the body, in a direction intersecting with a direction in which the cylinder is inserted into the body, and the single part is supported at its opposite ends by the body to prevent the single part and the cylinder from releasing from the body.

It is preferable that the single part includes a spring therein, and at least one end of the single part is slidable against the spring, and wherein the single part and the cylinder can be released from the body by sliding the one end of the single part.

For instance, the single part may be comprised of a pin.

The clasp may further include a coil spring energizing the cylinder in a direction in which the stopper engages to the pin, the coil spring being arranged around the cylinder and being arranged in the body through the single part.

The clasp may further include a surface-defining part separated from the body and cooperating with the body to define an outer surface of the clasp, the surface-defining part having a portion defining the outer surface of the clasp, the portion being ornamented differently from an outer surface of the body.

It is preferable that the surface-defining part is attached to the body through the single part.

It is preferable that the surface-defining part defines an outer surface of an end located oppositely to the releaser.

It is preferable that the releaser is comprised of a first releaser and a second releaser, the pin being released from the stopper by compressing the first and second releasers towards each other.

It is preferable that the pin is formed with at least one groove through which the stopper is engaged to the pin.

It is preferable that the stopper is comprised of a first stopper and a second stopper, the first stopper being released from the pin by means of the first releaser and the second stopper being released from the pin by means of the second releaser.

It is preferable that the first and second stoppers are engaged to the pin in such a manner as sandwiching the pin therebetween.

The clasp may further include a first cylinder to which the first stopper and the first releaser are integrally formed, and a second cylinder to which the second stopper and the second releaser are integrally formed, the first and second cylinders being movable relative to the body.

The clasp may further include a spring for energizing the first and second cylinders in a direction in which the fist and second stoppers are engaged to the pin.

It is preferable that the first and second cylinders and the spring are prevented from dropping off the body by means of the single part.

It is preferable that at least one of the body, the first cylinder, and the second cylinder is formed with a hole through which a sound generated when the stopper is engaged to the pin is emitted out of the clasp.

It is preferable that the first and second releasers partially define an outer surface of the body.

The advantages obtained by the aforementioned present invention will be described hereinbelow.

In the clasp in accordance with the present invention, the releaser and the stopper are both attached to the body by means of the single part in the body. The single part is not seen from outside of the body. Accordingly, the body can have good appearance at a surface thereof.

For instance, the single part is comprised of a pin. By using a pin as the single part, the releaser and the stopper can be readily arranged to the body. Furthermore, when the releaser and the stopper are arranged to the body, the body is not scratched at a surface.

The clasp may include the surface-defining part fabricated separately from the body, and ornamented differently from the body. The surface-defining part cooperates with the body to partially define an outer surface of the clasp, ensuring the clasp more ornamental.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

[First Embodiment]

Figure 1:
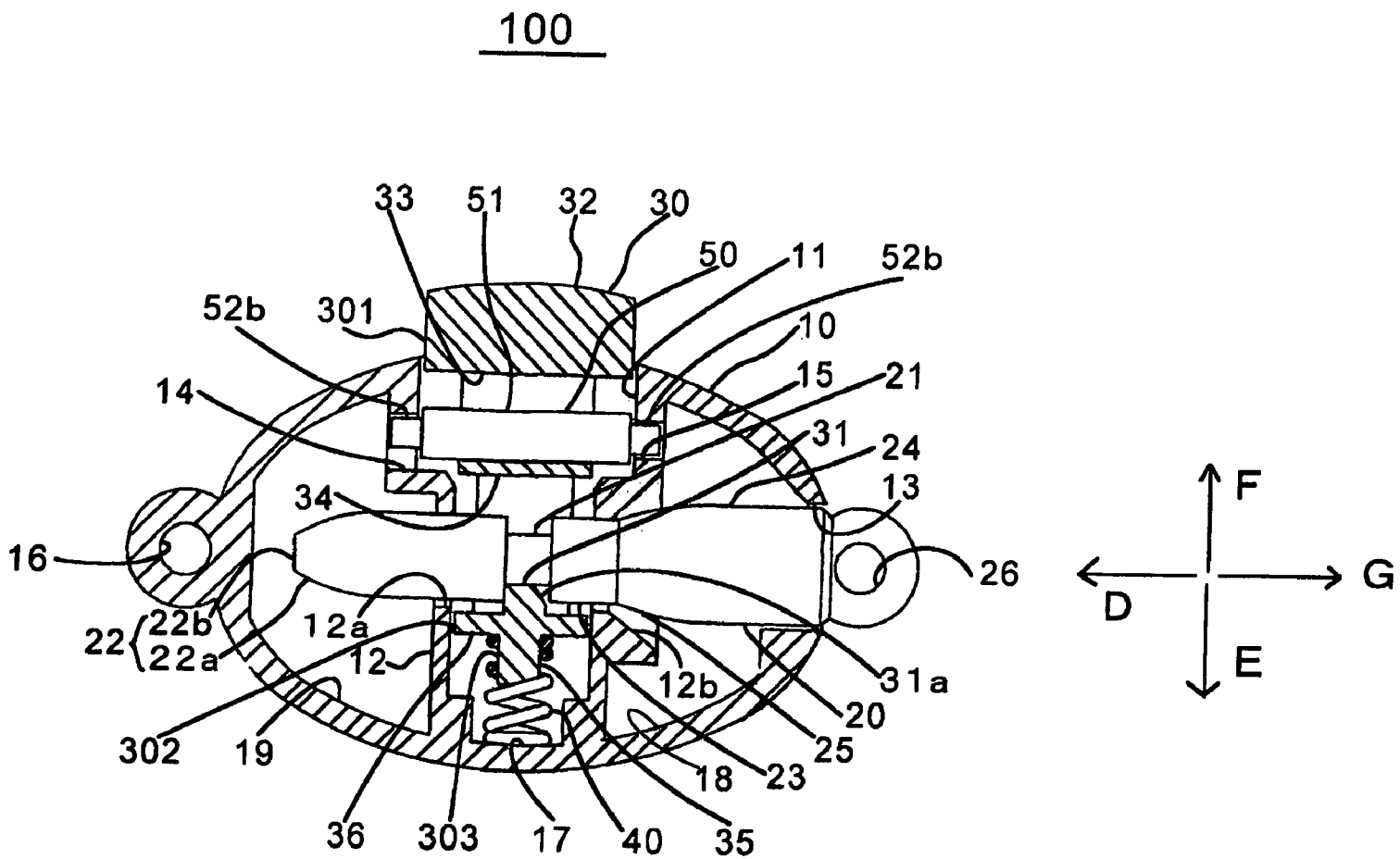
FIG. 1 is a cross-sectional view of the clasp in accordance with the first embodiment of the present invention.
Figure 2:
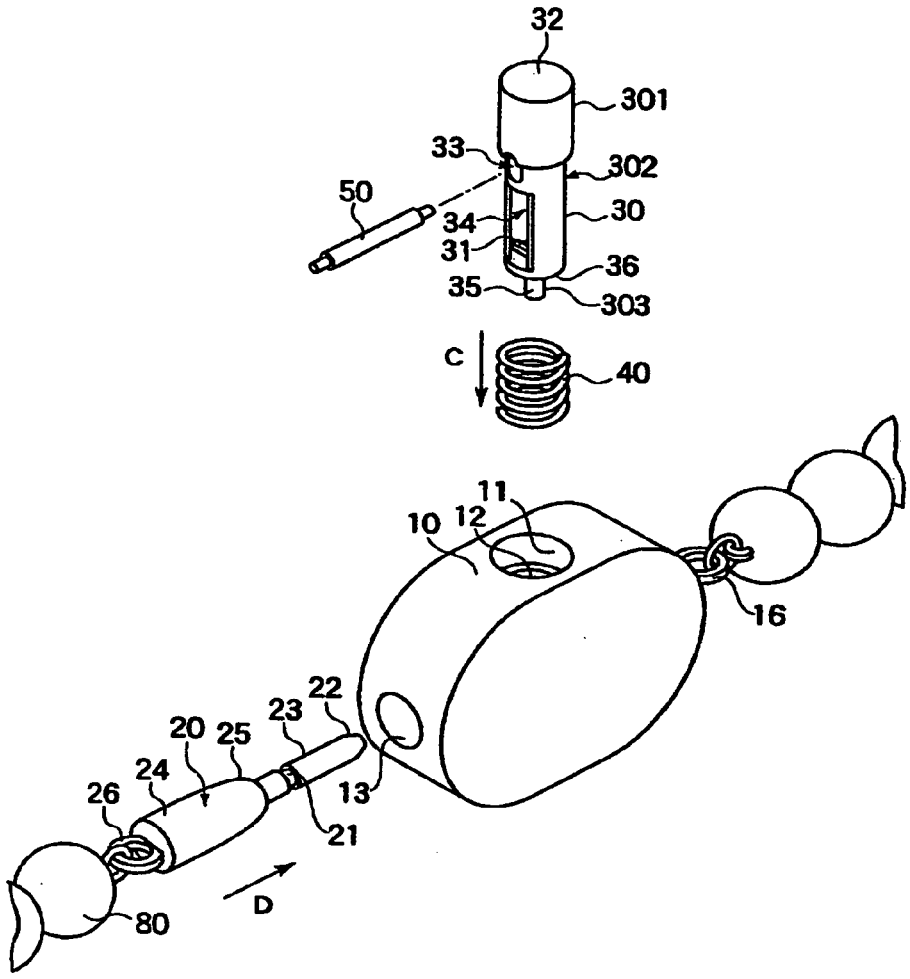
FIG. 2 is an exploded perspective view of the clasp in accordance with the first embodiment of the present invention.

FIG. 1 is a cross-sectional view of a clasp 100 in accordance with the first embodiment, and FIG. 2 is an exploded perspective view of the clasp 100. A horizontal positional relation in FIG. 2 is just opposite to FIG. 1.

As illustrated in FIGS. 1 and 2, the clasp 100 is comprised of a body 10, a pin 20 to be inserted into the body 10, a stopper 31 engaging to the pin 20 having been inserted into the body 10 to keep the pin 20 engaged to the body 10, and a releaser 32 which ceases engagement of the stopper 31 with the pin 20 to thereby release the pin 20 from the body 10.

The stopper 31 and the releaser 32 are formed integrally with each other. Specifically, the stopper 31 defines a part of a cylinder 30, and the releaser 32 also defines a part of the cylinder 30. The cylinder 30 is disposed in the body 10 so as to be movable relative to the body 10.

The clasp 100 further includes a coil spring 40 energizing the cylinder 30, and a pin 50 (corresponding to "a single part" defined in claims) preventing the coil spring 40 and the cylinder 30 from dropping out of the body 10.

The cylinder 30 including the stopper 31 and the releaser 32 is attached to the body 10 by means of the pin 50.

Figure 3:
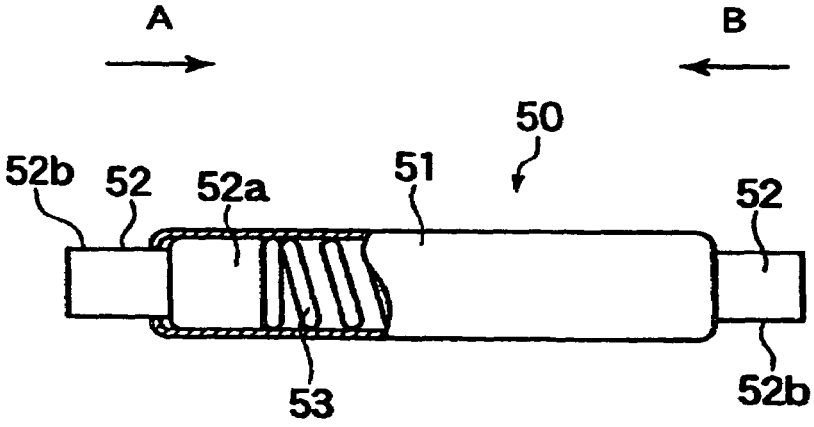
FIG. 3 is a front view, partially a cross-sectional view, of a pin used in the clasp in accordance with the first embodiment of the present invention.

FIG. 3 illustrates an example of a structure of the pin 50.

The pin 50 is comprised of a cylinder 51, a pair of bars 52 slidable in the cylinder 50 such that they can project through openings at opposite ends of the cylinder 51, and a coil spring 53 disposed in the cylinder 51 in compressed condition.

Each of the bars 52 is comprised of a first portion 52*a* slidable on an inner surface of the cylinder 51, and a second portion 52*b* having a diameter smaller than the same of the first portion 52*a*, and designed to project out of the cylinder 51 and extract into the cylinder 51.

The cylinder 51 is inwardly bent at opposite ends with the coil spring 53 and the bars 52 being disposed in the cylinder 51 such that openings at the opposite ends of the cylinder 51 have a diameter greater than the second portion 52*b*, but smaller than a diameter of the first portion 52*a*. Thus, the bars 52 and the coil spring 53 are prevented from dropping out of the cylinder 51.

Pushing the second portion 52*b* in a direction indicated with an arrow A or B, the first portion 52*a* slides along an inner surface of the cylinder 51, and the second portion 52*b* enters the cylinder against a force derived from the coil spring 53, as if the pin 50 extracts. Ceasing pushing the second portion 52*b*, the second portion 52*b* projects out of the cylinder 51 by virtue of a force derived from the coil spring 53, as if the pin 50 extends.

As illustrated in FIGS. 1 and 2, at least a portion of the pin 20, to be inserted into the body 10, is formed cylindrical. In the first embodiment, the pin 20 is entirely in the form of a cylinder.

The pin 20 is formed with a groove 21 to which the stopper 31 is engaged. For instance, the groove 21 is formed at a circumference thereof.

As illustrated in FIG. 1, a distal end 22 of the pin 20 is comprised of a planar end 22*b*, and a tapered portion 22*a* having a diameter gradually decreasing towards the planar end 22*b*. The tapered portion 22*a* guides the pin 20 to a predetermined position, when the pin 20 is inserted into the body 10. The planar end 22*b* of the pin 20 prevents a user from being injured, unlike a sharpened end.

The pin 20 includes a smaller-diameter portion 23 and a greater-diameter portion 24. The groove 21 and the distal end 22 are formed in the smaller-diameter portion 23. The pin 20 is designed to include the greater-diameter portion 24 for a user to readily pinch the pin 20.

A boundary portion 25 formed between the smaller-diameter portion 23 and the greater-diameter portion 24 has a diameter varying from a diameter of the smaller-diameter portion 23 to a diameter of the greater-diameter portion 24.

The pin 20 is formed at a proximal end of the greater-diameter portion 24 with a connector ring 26 through which the pin 20 is connected with a necklace 80 (see FIG. 2).

As illustrated in FIGS. 1 and 2, the cylinder 30 is formed with a first hole 33 through which the pin 50 is inserted into the cylinder 30, and a second hole 34 through which the smaller-diameter portion 23 of the pin 20 is inserted into the cylinder 30. In addition, the cylinder 30 includes, as well as the above-mentioned stopper 31 and the releaser 32, a spring holder 35 around which the coil spring 40 is arranged, and a spring-force receiver 36 on which the coil spring 40 acts a resilient force.

The cylinder 30 is in the form of a pin, and has a varying diameter. Specifically, as illustrated in FIG. 2, the cylinder 30 has a high-diameter portion 301, a middle-diameter portion 302 and a low-diameter portion 303 in this order.

The releaser 32 is formed at an end of the cylinder 30, specifically, at the high-diameter portion 301 of the cylinder 30.

The first hole 33 through which the pin 50 is inserted extends perpendicularly to a longitudinal axis of the cylinder 30. The first hole 33 is formed longer than a diameter of the cylinder 51 of the pin 50 in directions F and E indicated in FIG. 1 such that the cylinder 30 can move in a direction in which the stopper 31 is engaged to the pin 50 and in the opposite direction, that is, in the directions F and E, even when the pin 50 is inserted through the cylinder 30. The first hole 33 is slightly longer than a diameter of the cylinder 51 of the pin 50 in a direction perpendicular to a plane defined by FIG. 1.

The second hole 34 through which the pin 20 is inserted extends perpendicularly to a longitudinal axis of the cylinder 30. The first and second holes 33 and 34 extend in parallel with each other. Accordingly, the pin 20 and the pin 50 extend through the cylinder 30 in parallel with each other. The second hole 34 is formed longer than a diameter of the smaller-diameter portion 23 of the pin 20 in the directions F and E such that the cylinder 30 can move in the directions F and E, even when the pin 20 is inserted through the cylinder 30, but is slightly longer than a diameter of the smaller-diameter portion 23 of the pin 20 in a direction perpendicular to a plane defined by FIG. 1.

The stopper 31 is comprised of a projection standing on an inner surface of the second hole 34 and extending towards an axis of the second hole 34. Specifically, the stopper 31 stands on the spring holder 35. The stopper 31 has an inclining surface 31*a* facing a hole 13 through which the pin 20 in inserted into the body 10. The inclining surface 31*a* guides the distal end 22 of the pin 20 into the second hole 34.

For instance, the first hole 33 is formed across the high-diameter portion 301 and the middle-diameter portion 302, and the second hole 34 is formed at the middle-diameter portion 302.

The spring holder 35 is comprised of the low-diameter portion 303. A diameter of the spring holder 35, that is, a diameter of the low-diameter portion 303 is almost equal to an inner diameter of the coil spring 40.

The spring-force receiver 36 on which the coil spring 40 acts a resilient force is comprised of a step defining a boundary between the low-diameter portion 303 and the middle-diameter portion 302.

As illustrated in FIGS. 1 and 2, the body 10 is in the form of an elliptic cylinder. The body 10 is formed with a hole 11 in which the cylinder 30, the coil spring 40 and the pin 50 are arranged.

As mentioned later, the cylinder 30, the coil spring 40 and the pin 50 are inserted and arranged in the hole 11.

In the body 10, a cylindrical wall 12 defining the hole 11 is formed integrally with the body 10.

The body 10 is formed with a hole 13 through which the pin 20 is inserted into the body 10. The hole 13 has a longitudinal axis in which the pin 20 is inserted into the body 10, and which is perpendicular to a direction in which the cylinder 30 is inserted into the hole 11. A direction in which the pin 20 is inserted into the body 10 and a direction in which the cylinder 30 is inserted into the hole 11 lie in a common plane.

The wall 12 is formed with a through-hole 12*a*. The pin 20 inserted through the hole 13 passes through the through-hole 12*a*. The through-hole 12*a* is tapered at an end facing the hole 13. Specifically, the through-hole 12*a* has a tapered portion 12*b* having a greater diameter at a location closer to the hole 13. The tapered portion 12*b* guides the distal end 22 of the pin 20 into a center of the through-hole 12*a*.

The body 10 has a first internal space 18 formed between the wall 12 and the hole 13, and a second internal space 19 formed beyond the wall 12. When inserted into the body 10, the pin 20 is disposed in the first and second internal spaces 18 and 19.

The wall 12 is formed with a pair of holes 14 and 15 for positioning the pin 50. Specifically, the second portions 52*b* of the pin 50 are positioned by the holes 14 and 15, and resultingly, the pin 50 is positioned.

The hole 15 which faces the hole 13 has an inner diameter slightly greater than an outer diameter of the second portion 52*b* of the pin 50.

The hole 14 has an inner diameter slightly greater than an outer diameter of the second portion 52*b* of the pin 50 in a direction perpendicular to a plane defined by FIG. 1, but sufficiently greater than an outer diameter of the second portion 52*b* in the directions E and F. That is, the hole 14 is elongated in the directions E and F. This is because to ensure an area in which the second portion 52*b* can be inclined, when the pin 50 is taken out of the hole 14.

The hole 15 leads to the hole 11 and the first internal space 18, and the hole 14 leads to the hole 11 and the second internal space 19.

The body 10 is formed at an outer surface thereof with a connector ring 16 through which the necklace (see FIG. 2) is connected to the body 10. The connector rings 16 and 26 are located in symmetry with each other about a center of the body 10.

An inner surface 17 of a bottom of the hole 11 provides the coli spring 40 with a reaction force.

The coil spring 40 is comprised of a compressed coil spring.

The clasp 100 in accordance with the first embodiment is assembled as follows.

First, the spring holder 35 is inserted into the coil spring 40. Since the spring holder 35 has an outer diameter almost equal to an inner diameter of the coil spring 40, the coil spring 40 does not fall of the spring holder 35, even if the coil spring 40 is not supported with a hand of a user.

Then, the pin 50 is inserted into the first hole 33 of the cylinder 30.

Then, the coil spring 40 and the cylinder 30 are inserted into the hole 11 in a direction indicated with an arrow C in FIG. 2.

When the pin 50 is inserted into the hole 11, the pin 50 is inclined such that one of the second portions 52*b* can be inserted into the hole 14, and the other second portion 52*b* kept in a contracted condition. The contracted second portion 52*b* is slid at a distal end thereof on an inner surface of the hole 11 to thereby insert the cylinder 30 into the hole 11.

After the pin 50 entered the hole 11, the end 37 is pushed in the direction C. As a result, when the contracted second portion 52*b* reaches the hole 15, the contracted second portion 52*b* extends into the hole 15 by virtue of the spring 53 disposed in the pin 50. Thus, the pin 50 is positioned as illustrated in FIG. 1.

Ceasing pushing the releaser 32 in the direction C, the cylinder 30 and the coil spring 40 are positioned as illustrated in FIG. 1.

When the pin 50 is arranged in the body 10 in such a manner as illustrated in FIG. 1, the cylinder 30, the pin 50 and the coil spring 40 do not fall off the body 10, even if a force for compressing the releaser 32 of the cylinder 30 in the direction E is ceased. This is because a pair of the second portions 52*b* of the pin 50 receives a reaction force from the holes 14 and 15, and a reaction force from the cylinder 30, and further because the coil spring 40 receives a reaction force from the spring-force receiver 36.

In FIG. 1, the coil spring 40 is sandwiched between the spring-force receiver 36 and the inner surface 17 of the bottom of the hole 11 in a compressed condition.

Thus, the releaser 32 is kept external of the body 10.

An operation of the clasp 100 is explained hereinbelow.

First, the engagement of the stopper 31 with the pin 20 is explained hereinbelow.

First, with reference to FIG. 2, the pin 20 is inserted through the distal end 22 thereof into the hole 13 of the body 10 in the direction D. Even if the distal end 22 is out of a center of the through-hole 12*a*, the tapered portion 12*b* guides the distal end 22 to a center of the through-hole 12*a*.

When, after the distal end 22 of the pin 20 was inserted into the second hole 34 and reached the stopper 31, the pin 20 is further inserted into the second hole 34, the stopper 31 is compressed by the tapered portion 22*a*, and moves in the direction E against a spring force generated by the coil spring 40. Whereas the cylinder 30 moves in the direction E together with the stopper 31, the pin 50 is kept stationary. Since the cylinder 30 moves in the direction E, the pin 50 relatively moves in the direction F opposite to the direction E in the second hole 34 relative to the cylinder 30.

Thereafter, the pin 20 is further inserted deeply into the body 10. When the groove 21 reaches the stopper 31, the stopper 31 is energized by the coil spring 40 to move in the direction F. Thus, the stopper 31 enters the groove 21. That is, the stopper 31 is engaged to the groove 21. When the stopper 31 moves, the cylinder 30 also moves in the direction F. Though the pin 50 does not move, since the cylinder 30 moves in the direction F, the pin 50 relatively moves in the direction E in the second hole 34 relative to the cylinder 30.

Thus, the stopper 31 is engaged to the pin 20 as illustrated in FIG. 1, ensuring that the pin 20 is prevented from releasing from the body 10.

Next, an operation for ceasing the engagement of the stopper 31 with the pin 20 is explained hereinbelow.

In order to release the pin 20 from the stopper 31, a user pushes the releaser 32 in the direction E. Specifically, the engagement of the stopper 31 with the pin 20 can be ceased by pushing the cylinder 30 including the releaser 32 in the direction E against a spring force provided by the coil spring 40. Thereafter, the pin 20 can be pulled out of the body 10 in the direction G.

An operation for exchanging a part into a new one for some reason is explained hereinbelow with reference to FIG. 4.

For instance, when any part is broken, or any part is exchanged to another ornamental part, part-exchange operation is carried out.

A part is exchanged to another part after the pin 20 was pulled out of the body 10.

While the pin 20 is pulled out of the body 10, a pin (not illustrated) is inserted into the hole 15 through the first internal space 18. Then, one of the second portions 52*b* is contracted with a distal end of the pin. As a result, the end of the pin 50 at which the one of the second portions 52*b* is contracted moves in the direction F in FIG. 1 by a spring force provided by the coil spring 40, and accordingly, the pin 50 is inclined in the first hole 33. The other second portion 52*b* is inclined in the hole 14.

The end of the pin 50 at which the one of the second portions 52*b* is contracted further moves in the direction F along an inner wall of the hole 11 by a spring force provided by the coil spring 40, and resultingly, the pin 50 is further inclined. As the pin 50 moves, the cylinder 30 moves in the direction F.

Thus, the releaser 32 can be taken out of the hole 11 together with the pin 50 and the coil spring 40. Thus, any one or more of the pin 50, the coil spring 40, the cylinder 30 and the body 10 may be replaced with a new one.

In accordance with the above-mentioned first embodiment, since the cylinder 30 or both the releaser 32 and the stopper 31 is(are) arranged in the body 10 by means of a single part, that is, the pin 50 disposed in the body 10, the pin 50 is hidden in the body 10, and cannot be seen from outside of the body 10. Hence, the clasp 100 can have good appearance.

In addition, since the cylinder 30 and the coil spring 40 can be arranged in the body 10 by means of the single pin 50, it would be possible to fabricate the clasp 100 with the small number of parts, readily assemble the clasp 100, and readily replace a part with a new one. Furthermore, when the clasp 100 is fabricated, the body 10 will not be scratched.

Though the body 10 in the first embodiment is in the form of an elliptic cylinder, the body 10 may be in any form. For instance, the body 10 may be rectangular parallelepiped or spherical.

[Second Embodiment]

Figure 4:
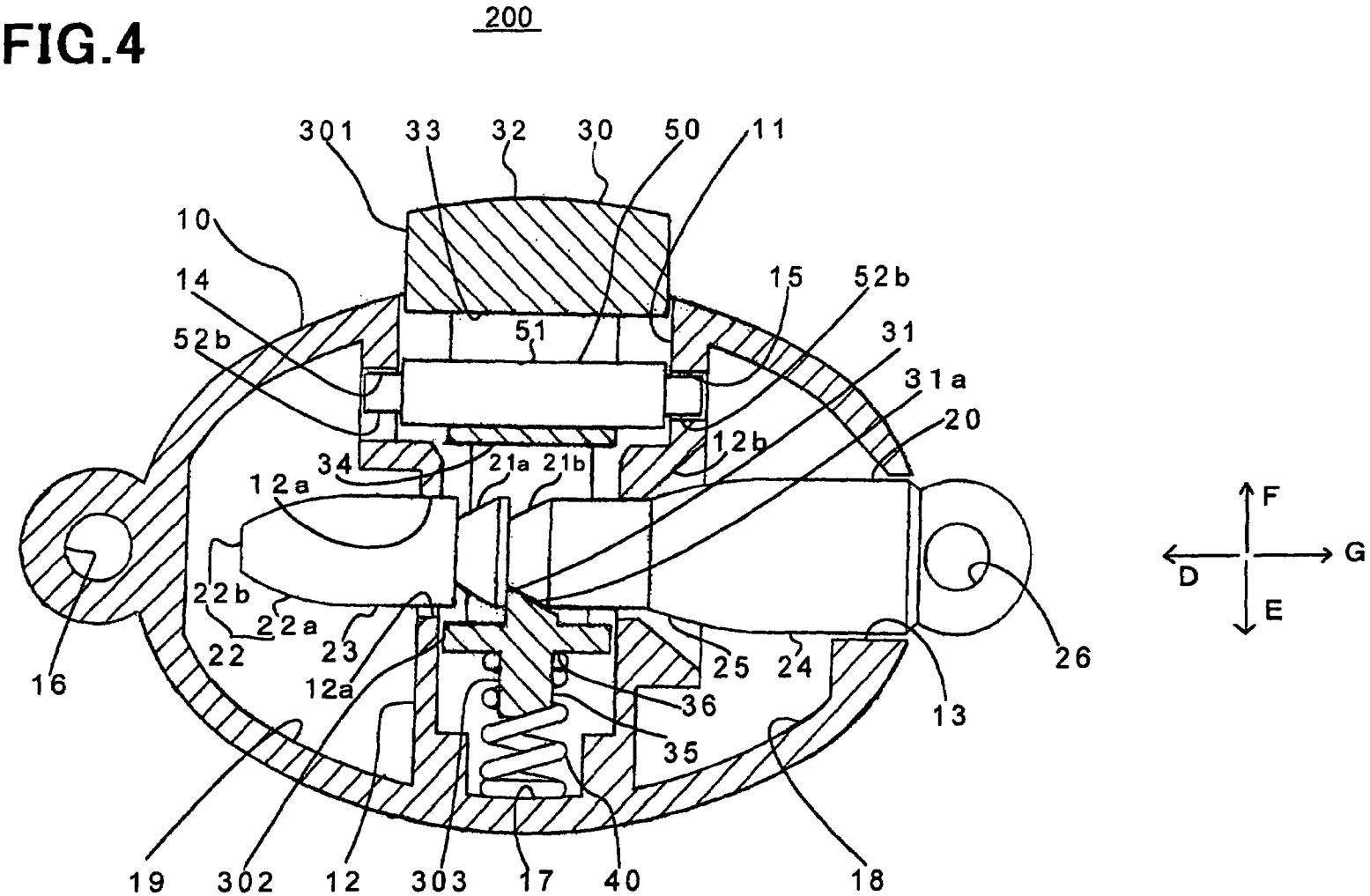
FIG. 4 is a cross-sectional view of the clasp in accordance with the second embodiment of the present invention.

FIG. 4 is a cross-sectional view of a clasp 200 in accordance with the second embodiment of the present invention.

Hereinbelow is explained the clasp 200 with reference to FIG. 4.

The clasp 200 is structurally different from the clasp 100 in accordance with the first embodiment only in what is explained later. Hence, parts or elements that correspond to clasp 100 have been provided with the same reference numerals, and are not explained.

As illustrated in FIG. 4, the pin 20 in the second embodiment is formed with a plurality of grooves 21*a* and 21*b* arranged longitudinally of the pin 20.

Since the stopper 31 may be engaged to one of the grooves 21*a* and 21*b*, it would be possible to control a length of the necklace 80 (see FIG. 2), that is, a length in the directions D and G in FIG. 4.

By causing the stopper 31 to be engaged to the groove 21*b*, if the stopper 31 is accidentally released from the pin 20, the stopper 31 would be engaged again to the groove 21*a*, keeping the pin 20 engaged to the body 10. Thus, it is possible to reduce possibility that the necklace 80 (see FIG. 2) connected to the clasp 200 accidentally drops out of the clasp 200.

Each of the grooves 21*a* and 21*b* has a diameter reducing towards the distal end 22 of the pin 20. Accordingly, when the pin 20 is inserted in the direction D, the stopper 31 can readily shift to an adjacent groove, but the stopper 31 is unlikely to release from the groove, even when the pin 20 is pulled in the direction G.

A critical strength at which the pin 20 is released from the stopper 31 when the pin 20 is pulled in the direction G is determined in dependence on an angle and a height of the grooves 21*a* to 21*c*, and a strength of the coil spring 40.

The second embodiment provides the same advantages as those provided by the first embodiment, and provides the additional advantage that a plurality of the grooves 21*a* and 21*b* makes it possible to vary a length of the clasp.

It would be possible to control a length of the pin 20 projecting outwardly beyond the body 10. Thus, among a plurality of the bodies 10 having different lengths between the stopper 31 and the hole 13, a preferable one can be selected.

Though the pin 20 in the second embodiment is designed to have two grooves 21*a* and 21*b*, it should be noted that the pin 20 may be designed to have three or more grooves.

[Third Embodiment]

Figure 5:
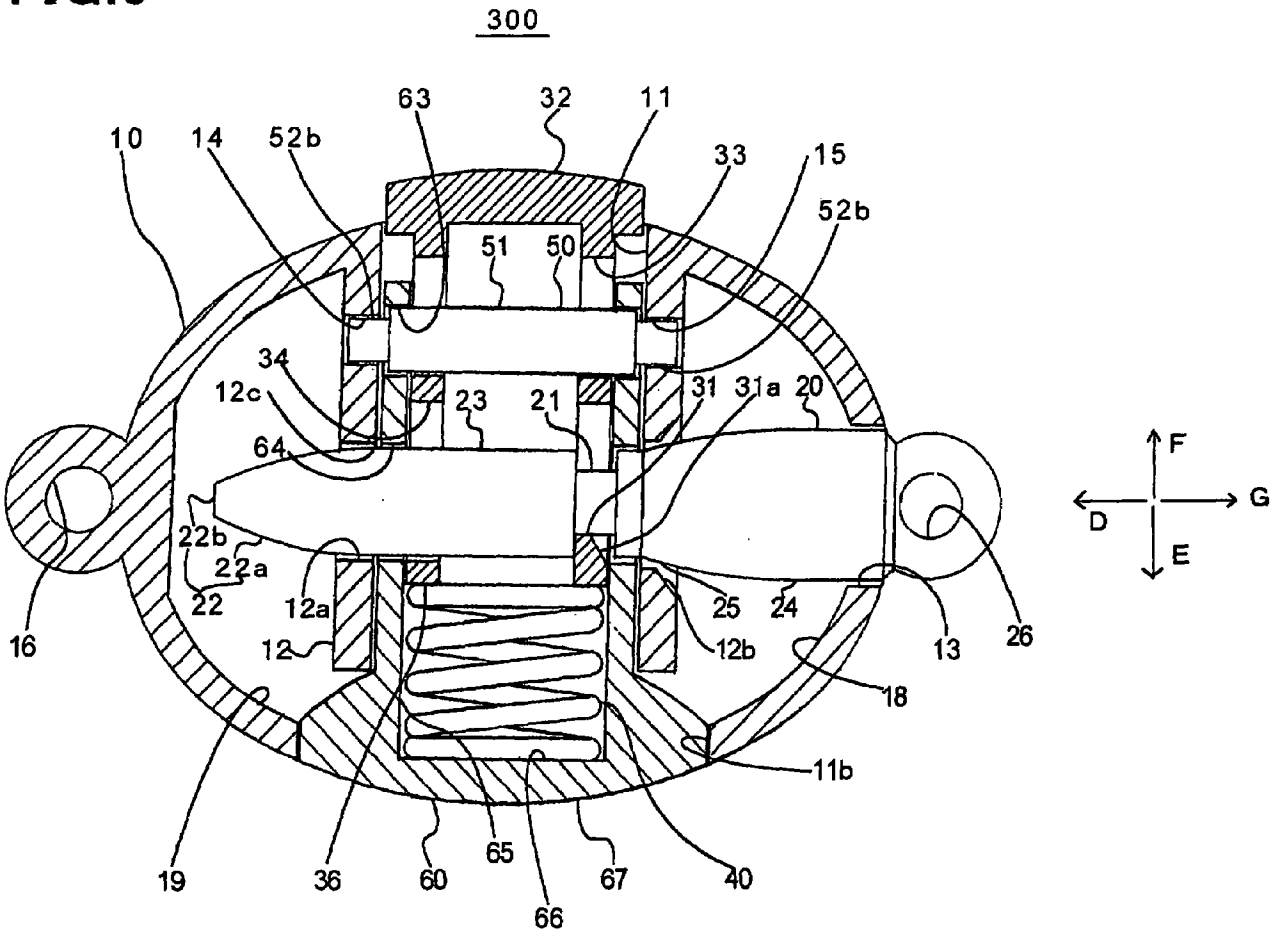
FIG. 5 is a cross-sectional view of the clasp in accordance with the third embodiment of the present invention.
Figure 6:
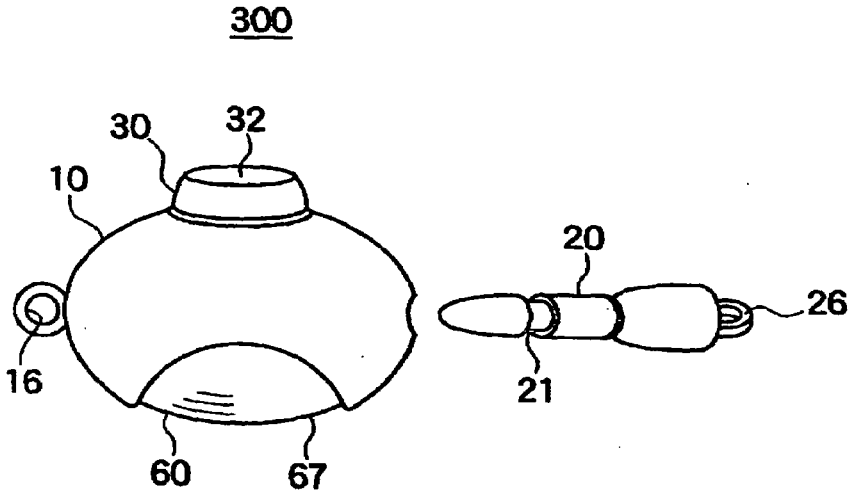
FIG. 6 is a perspective view of the clasp in accordance with the third embodiment of the present invention.

FIG. 5 is a cross-sectional view of a clasp 300 in accordance with the third embodiment of the present invention, and FIG. 6 is a perspective view of the clasp 300.

Hereinbelow is explained the clasp 300 with reference to FIGS. 5 and 6.

The clasp 300 is structurally different from the clasp 100 in accordance with the first embodiment only in what is explained later. Hence, parts or elements that correspond to clasp 100 have been provided with the same reference numerals, and are not explained.

As illustrated in FIGS. 5 and 6, the clasp 300 is comprised of a body 10, a pin 20, a cylinder 30 including a stopper 31 and a releaser 32, a coil spring 40, and a pin 50, and comprised further of a surface-defining part 60 fabricated separately from the body 10, and cooperating with the body 10 to define an outer surface of the clasp 300.

The pin 20, the coil spring 40 and the pin 50 have the same structure as those in the first embodiment.

As illustrated in FIGS. 5 and 6, the surface-defining part 60 includes a first through-hole 63 into which the pin 50 is inserted, a second through-hole 64 into which the pin 20 (in particular, the smaller-diameter portion 23) is inserted, a recess 65 in which the coil spring 40 is disposed, a force-provider 66 providing the coil spring 40 with a reaction force, and a surface-defining portion 67 cooperating with the body 10 to define an outer surface of the clasp 300.

The surface-defining part 60 is in the form of a cylinder one of ends of which is closed.

The closed end of the surface-defining part 60 defines the surface-defining portion 67. The surface-defining portion 67 is formed and arranged to define a surface continuous with an outer surface of the body 10. Specifically, the surface-defining portion 67 is designed to have such shape and dimension as defining a part of an elliptic ball having the same dimension as that of the body 10.

The first through-hole 63 has an axis extending perpendicularly to an axis of the surface-defining part 60. The first through-hole 63 has a diameter slightly greater than a diameter of the pin 50.

The second through-hole 64 has an axis extending perpendicularly to an axis of the surface-defining part 60. The second through-hole 64 has a diameter slightly greater than a diameter of the smaller-diameter portion 23 of the pin 20. The first and second through-holes 63 and 64 extend in parallel with each other. Hence, the pin 20 and the pin 50 pass through the surface-defining part 60 in parallel with each other.

The recess 65 is defined by an inner wall of the surface-defining part 60 located closer to the surface-defining portion 67 than the second through-hole 64. The recess 65 has a diameter slightly greater than an outer diameter of the coil spring 40.

The force-provider 66 providing the coil spring 40 with a reaction force is defined by a bottom of the recess 65.

In the surface-defining part 60, at least the surface-defining portion 67 is designed to have decoration different from the same of an outer surface of the body 10. For instance, the surface-defining portion 67 is colored or finished differently from an outer surface of the body 10.

As an alternative, symbols may be marked onto the surface-defining portion 67. For instance, a company name, a name of a shop, a name of goods, an initial of a user, or an anniversary day may be marked onto the surface-defining portion 67.

As illustrated in FIGS. 5 and 6, the cylinder 30 in the third embodiment includes the stopper 31 and the releaser 32, and further includes a first hole 33 into which the pin 50 is inserted, a second hole 34 through which the smaller-diameter portion 23 of the pin 20 is inserted, and a spring-force receiver 36 on which the coil spring 40 acts a resilient force.

Similarly to the surface-defining part 60, the cylinder 30 in the third embodiment is in the form of a cylinder one of ends of which is closed.

The cylinder 30 has an outer diameter slightly smaller than an inner diameter of the surface-defining part 60. Hence, the cylinder 30 is insertable into the surface-defining part 60.

The closed end of the cylinder 30 defines the releaser 32.

The first hole 33 through which the pin 50 is inserted extends perpendicularly to a longitudinal axis of the cylinder 30. The first hole 33 is formed longer than a diameter of the cylinder 51 of the pin 50 in directions F and E indicated in FIG. 5 such that the cylinder 30 can move in a direction in which the stopper 31 is engaged to the pin 50 and in the opposite direction, that is, in the directions F and E, even when the pin 50 is inserted through the cylinder 30. The first hole 33 is slightly longer than a diameter of the cylinder 51 of the pin 50 in a direction perpendicular to a plane defined by FIG. 5.

The second hole 34 through which the pin 20 is inserted extends perpendicularly to a longitudinal axis of the cylinder 30. The first and second holes 33 and 34 extend in parallel with each other. Accordingly, the pin 20 and the pin 50 extend through the cylinder 30 and the surface-defining part 60 in parallel with each other.

The second hole 34 is formed longer than a diameter of the smaller-diameter portion 23 of the pin 20 in the directions F and E such that the cylinder 30 can move in the directions F and E, even when the pin 20 is inserted through the cylinder 30, but is slightly longer than a diameter of the smaller-diameter portion 23 of the pin 20 in a direction perpendicular to a plane defined by FIG. 5.

The stopper 31 is formed in an opening located closer to the hole 13 among openings formed at opposite ends of the second hole 34. Specifically, the stopper 31 is formed on an inner edge of the opening located closer to the hole 13 such that the stopper 31 faces the releaser 32.

The stopper 31 has an inclining surface 31*a* facing the hole 13 through which the pin 20 in inserted into the body 10. The inclining surface 31*a* guides the distal end 22 of the pin 20 into the second hole 34.

The second hole 34 is located remoter from the releaser 32 than the first hole 33.

The spring-force receiver 36 on which the coil spring 40 acts a resilient force is comprised of an end surface of an opening end of the cylinder 30.

The body 10 in the third embodiment is structurally different from the body 10 in the first embodiment as follows.

The hole 11 is formed throughout the body 10. The surface-defining part 60 is disposed in the hole 11. An opening end 11*b* of the hole 11 in which the surface-defining part 60 is inserted has a diameter greater than a diameter of the opposite end of the hole 11.

The body 10 in the third embodiment does not have the inner surface 17 of a bottom of the hole 11 for providing the coli spring 40 with a reaction force.

The wall 12 is formed in accordance with an outline of the surface-defining part 60.

The holes 14 have the same dimension as that of the holes 15.

The parts are assembled into the clasp 300 as follows.

First, the coil spring 40 is inserted into the recess 65. Then, the cylinder 30 is inserted into the surface-defining part 60 through an opening end thereof.

Then, the cylinder 30 and the surface-defining part 60 are aligned with each other such that the first hole 33 and the first through-hole 63 are in alignment with each other.

Then, the cylinder 30, the surface-defining part 60, and the coil spring 40 are inserted into the hole 11 through the opening end 11*b*.

When the first through-hole 63 reaches a position at which the first through-hole 63 is in alignment with the hole 12*a* of the hole 12, the releaser 32 is pushed in the direction E to move the cylinder 30 in the direction E, such that the first through-hole 33 of the cylinder 30 is in alignment with the first through-hole 63 of the surface-defining part 60.

Then, the pin 50 is put into the body 10 through the hole 13, and thereafter, inserted into the through-holes 33 and 63 through the first internal space 18 and the holes 12*a*.

When the pin 50 is inserted into the through-holes 33 and 63, one of the second portions 52*b* of the pin 50 is pushed onto a corner 12*c* of the hole 12*a* to contract the one of the second portion 52*b*, with the pin 50 being slightly inclined. The other second portion 52*b* is also contracted.

With the second portions 52*b* of the pin 50 being kept contracted, the surface-defining portion 67 of the surface-defining part 60 is compressed in the direction F. The contracted second portions 52*b* slide on an inner wall of the wall 12 in the direction E. As the pin 50 moves in the direction E, the surface-defining part 60, the cylinder 30 and the coil spring 40 move in the direction E.

When the contracted second portion 52*b* reaches the holes 14 and 15, the contracted second portion 52*b* extends into the holes 14 and 15 by virtue of a spring force provided by the spring 53 disposed in the pin 50.

Thus, the parts except the cylinder 20 are assembled into the clasp 300. Specifically, the cylinder 30 and the surface-defining part 60 are arranged in the body 10 through the pin 50 in such a condition that the cylinder 30 and the surface-defining part 60 are connected to each other through the pin 50.

The coil spring 40 is sandwiched between the spring-force receiver 36 of the cylinder 30 and the force-provider 66 of the surface-defining part 60 in a compressed condition in the recess 65.

The releaser 32 is kept projecting beyond the body 10.

The surface-defining portion 67 of the surface-defining part 60 is positioned to be continuous with an outer surface of the body 10. In other words, the surface-defining portion 67 cooperates with the body 10 to define an outer surface of the clasp 300.

The stopper 31 is engaged to the pin 20 and the stopper 31 is released from the pin 20 in the same manner as the first embodiment.

A part is exchanged to another part after the pin 20 was pulled out of the body 10.

While the pin 20 is pulled out of the body 10, a pin (not illustrated) is inserted into the body 10 through the hole 13, and further into the hole 15 through the first internal space 18. Then, one of the second portions 52*b* is contracted with a distal end of the pin. Then, a J-shaped pin (not illustrated) is inserted into the body 10 through the hole 13, and further into the hole 14 through the first and second internal spaces 18 and 19. Then, the other second portion 52*b* is contracted with a distal end of the J-shaped pin.

With the second portions 52*b* of the pin 50 being contracted, the releaser 32 is pushed in the direction E. As a result, the pin 50, the cylinder 30, the coil spring 40 and the surface-defining part 60 move in the direction E in FIG. 5.

When the contracted second portions 52*b* of the pin 50 reach the holes 12*a* of the wall 12, the second portions 52*b* extend into the holes 12*a* by a spring force provided by the spring 53, and resultingly, the pin 50 drops off the body 10. Then, the pin 50 is taken out of the body 10 through the first internal space 18 and the hole 13.

Then, the releaser 32 is further pushed in the direction E, resulting in that the cylinder 30, the surface-defining part 60 and the coil spring 40 can be taken out of the opening end 11*b* of the hole 11.

Thus, any one or more of the pin 50, the coil spring 40, the cylinder 30, the surface-defining part 60 and the body 10 can be replaced with a new one.

In place of using the above-mentioned J-shaped pin, the body 10 may be formed at an outer surface of the second internal space 19 with a hole (not illustrated) in alignment with the hole 14, in which case, a pin is inserted into the hole 14 through the hole and the second internal space 19, and one of the second portions 52*b* is contracted with the pin.

In the clasp 300 in accordance with the third embodiment, since the surface-defining part 60 formed separately from the body 10 is decorated differently from the body 10, and cooperates with the body 10 to define an outer surface of the clasp 300, the clasp 300 could be ornamented to an enhanced degree.

[Fourth Embodiment]

Figure 7:
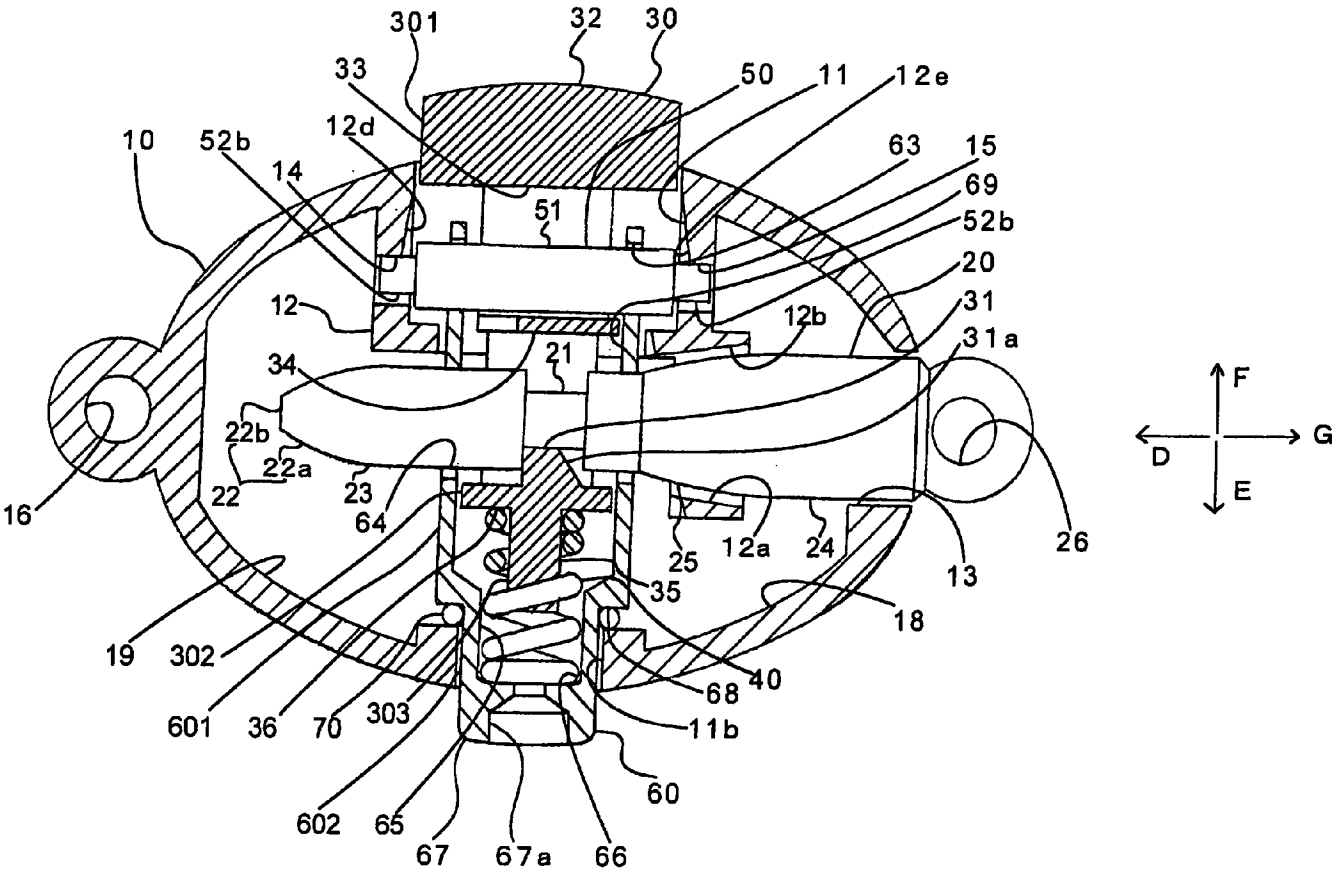
FIG. 7 is a front view of a pin used in the clasp in accordance with the fourth embodiment of the present invention.

FIG. 7 is a cross-sectional view of a clasp 400 in accordance with the fourth embodiment of the present invention.

Hereinbelow is explained the clasp 400 with reference to FIG. 7.

The clasp 400 is structurally different from the clasp 300 in accordance with the third embodiment only in what is explained later. Hence, parts or elements that correspond to clasp 100 have been provided with the same reference numerals, and are not explained.

As illustrated in FIG. 7, the clasp 400 is comprised of a body 10, a pin 20, a cylinder 30 including a stopper 31 and a releaser 32, a coil spring 40, and a pin 50, and comprised further of a surface-defining part 60 fabricated separately from the body 10, and cooperating with the body 10 to define an outer surface of the clasp 300, and a buffer ring 70 for relaxing contact between the surface-defining part 60 and the body 10.

The pin 20, the cylinder 30, the coil spring 40 and the pin 50 have the same structure as those in the first embodiment.

As illustrated in FIG. 7, the surface-defining part 60 includes a first through-hole 63 into which the pin 50 is inserted, a second through-hole 64 into which the pin 20 (in particular, the smaller-diameter portion 23) is inserted, a hole 69 into which the cylinder 30 is inserted, a recess 65 in which the coil spring 40 is disposed, a force-provider 66 providing the coil spring 40 with a reaction force, and a surface-defining portion 67 cooperating with the body 10 to define an outer surface of the clasp 400.

The surface-defining part 60 is in the form of a cylinder one of ends of which is closed.

An inner surface of the surface-defining part 60 defines the hole 69 into which the cylinder 30 is inserted.

The closed end of the surface-defining part 60 defines the surface-defining portion 67. The surface-defining portion 67 is formed to project beyond an outer surface of the body 10.

The first through-hole 63 has an axis extending perpendicularly to a longitudinal axis of the surface-defining part 60. The first through-hole 63 has a diameter slightly greater than a diameter of the cylinder 51 of the pin 50.

The second through-hole 64 has an axis extending perpendicularly to a longitudinal axis of the surface-defining part 60. The second through-hole 64 has a diameter slightly greater than a diameter of the smaller-diameter portion 23 of the pin 20. The first and second through-holes 63 and 64 extend in parallel with each other. Hence, the pin 20 and the pin 50 pass through the surface-defining part 60 in parallel with each other.

The recess 65 is defined by an inner wall of the surface-defining part 60 located closer to the surface-defining portion 67 than the second through-hole 64. The recess 65 has an inner diameter slightly greater than an outer diameter of the coil spring 40.

The force-provider 66 providing the coil spring 40 with a reaction force is defined by a bottom of the recess 65.

As illustrated in FIG. 7, the surface-defining part 60 is comprised of a greater-diameter portion 601 and a smaller-diameter portion 602 adjacent to each other.

The first and second through-holes 63 and 64 are formed at the greater-diameter portion 601.

The surface-defining portion 67 and the recess 65 are formed at the smaller-diameter portion 602.

A step formed between the greater-diameter portion 601 and the smaller-diameter portion 602 defines a buffer ring holder 68 which cooperates with an inner surface of the body 10 to sandwich the buffer ring 70 therebetween.

The surface-defining portion 67 of the surface-defining part 60 is formed with a recess 67 in which jewelry or charm is mounted. Such jewelry or charm may be mounted in the recess 67 in advance or later. That is, such jewelry or charm can be mounted in accordance with a request of a user, for instance, in a jewelry shop. For instance, a birthstone of a user may be mounted in the recess 67 in a jewelry shop.

Similarly to the above-mentioned third embodiment, it is preferable that at least the surface-defining portion 67 in the surface-defining part 60 may be decorated differently from an outer surface of the body 10.

The body 10 in the fourth embodiment is structurally different from the body 10 in the first embodiment as follows.

The hole 11 is formed throughout the body 10. The surface-defining part 60 is disposed in the hole 11. An opening end 11*b* of the hole 11 in which the surface-defining part 60 is inserted has a diameter smaller than a diameter of the opposite end of the hole 11.

The body 10 in the fourth embodiment does not have the inner surface 17 of a bottom of the hole 11 for providing the coli spring 40 with a reaction force.

The wall 12 partially defines the hole 11. The hole 12*a* is formed at the wall 12 only at the side of the hole 13.

The holes 14 have the same dimension as that of the holes 15. However, the holes 14 and 15 in the fourth embodiment have an inner diameter slightly greater than the same in the first embodiment, ensuring that the second portions 52*b* of the pin 50 are located in the holes 14 and 15 with a play.

The wall 12 is formed at an inner surface thereof with inclined surfaces 12*d* and 12*e* an inner space between which is narrowing towards an opening end of the hole 11.

The buffer ring 70 has an inner diameter almost equal to an outer diameter of the smaller-diameter portion 602 of the surface-defining part 60. Hence, after the buffer ring 70 has been set around the smaller-diameter portion 602 of the surface-defining part 60, the buffer ring 70 would not drop off the smaller-diameter portion 602, even if a user releases his/her hand from the buffer ring 70.

The parts are assembled into the clasp 400 as follows.

First, the coil spring 40 is partially inserted into the spring holder 35 of the cylinder 30. Since the spring holder 35 has an outer diameter almost equal to an inner diameter of the coil spring 40, the coil spring 40 would not drop off the spring holder 35, even if a user releases his/her hand from the coil spring 40.

Then, the coil spring 40 and the cylinder 30 are inserted into the hole 68 of the surface-defining part 60 such that the coil spring 40 goes ahead.

Then, the releaser 32 is pushed in the direction E, and the surface-defining portion 67 is pushed in the direction F such that the first through-hole 63 of the surface-defining part 60 and the first through-hole 33 of the cylinder 30 are in alignment with each other. Then, the pin 50 is inserted into the holes 63 and 33.

Thus, the cylinder 30 and the surface-defining part 60 are connected to each other through the pin 50. The coil spring 40 is sandwiched in the recess 65 between the spring-force receiver 36 and the force-provider 66 in a compressed condition.

Then, the buffer ring 70 is pushed to a proximal end of the smaller-diameter portion 602 of the surface-defining part 60. Since the smaller-diameter portion 602 has an outer diameter almost equal to an inner diameter of the buffer ring 70, the buffer ring 70 would not drop off the smaller-diameter portion 602, even if a user releases his/her hand from the buffer ring 70.

With the second portions 52*b* of the pin 50 being contracted, the surface-defining part 60, the buffer ring 70, the coil spring 40, the pin 50 and the cylinder 30 are inserted into the hole 11 in the direction E.

During the insertion of them, the contracted second portions 52*b* of the pin 50 slide on an inner surface of the hole 11 until they reach the holes 14 and 15. When the contracted second portions 52*b* reach the holes 14 and 15, the second portions 52*b* extend into the holes 14 and 15 by a force provided by the spring 53 disposed in the pin 50.

The surface-defining portion 67 projects beyond the body 10 through the opening end 11*b*. The buffer ring 70 is sandwiched between an inner surface of the body 10 and the hole 68.

Since the second portions 52*b* are positioned in the holes 14 and 15, the surface-defining part 60, the buffer ring 70, the coil spring 40, the pin 50 and the cylinder 30 do not fall off the body 10.

The releaser 32 is kept projecting beyond the body 10.

The stopper 31 is engaged to the pin 20 and the stopper 31 is released from the pin 20 in the same manner as the first embodiment.

A part of the clasp 400 can be exchanged to a new one in the same way as the first embodiment.

The hole 14 in the fourth embodiment has a diameter smaller than the same in the first embodiment. However, since the hole 15 in the fourth embodiment has a diameter greater than the same in the first embodiment, and the wall 12 is formed with the inclined surfaces 12*d* and 12*e*, a part of the clasp 400 can be readily changed to a new one.

The clasp 400 in accordance with the fourth embodiment provides the same advantages as those provided by the third embodiment. In addition, since the surface-defining portion 67 is formed with the recess 67*a* on which jewelry or charm may be mounted, the clasp 400 could be decorated to a high degree.

[Fifth Embodiment]

In the above-mentioned first to fourth embodiments, the pin 20 is released from the stopper 31 by pushing the releaser 32. Accordingly, the releaser 32 unavoidably projects beyond the body 10, degrading appearance of the clasp.

In the clasps in accordance with the fifth to eighth embodiments explained hereinbelow, the releaser is designed not to project beyond a body, ensuring good appearance of the clasp.

Figure 8:
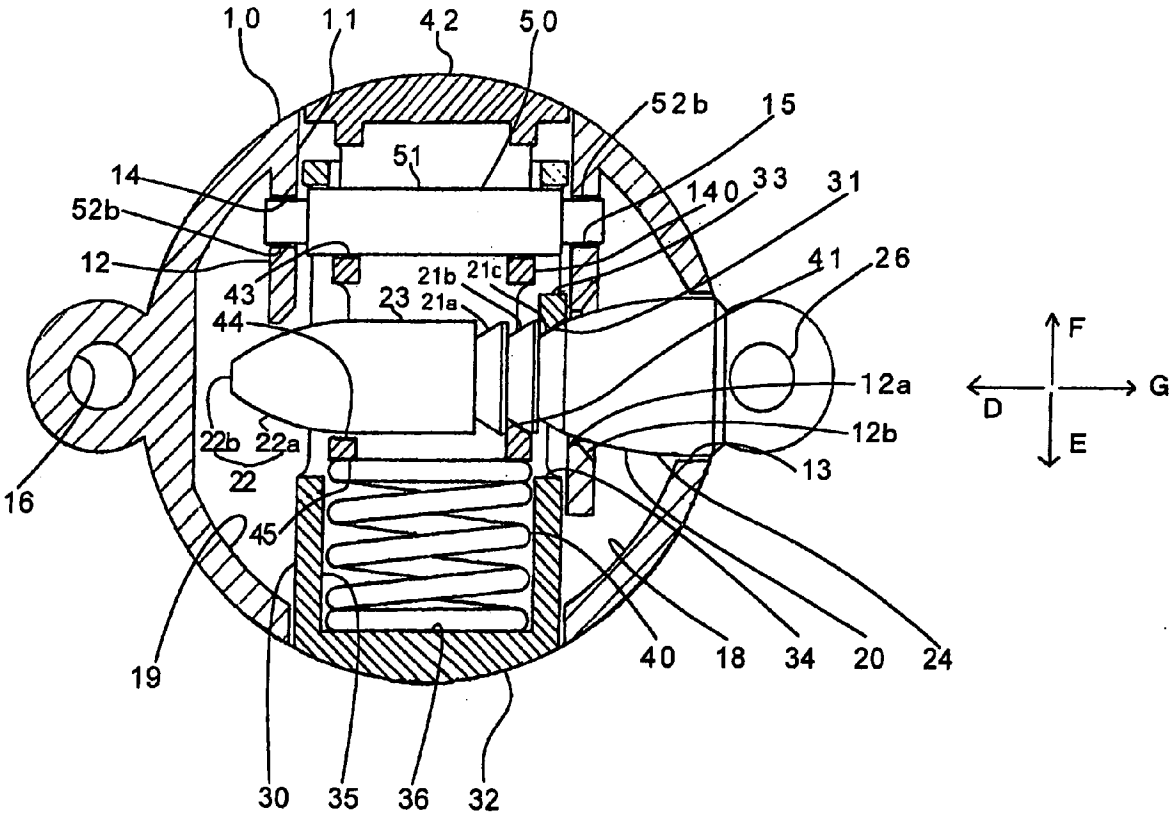
FIG. 8 is a cross-sectional view of the clasp in accordance with the fifth embodiment of the present invention.
Figure 9:
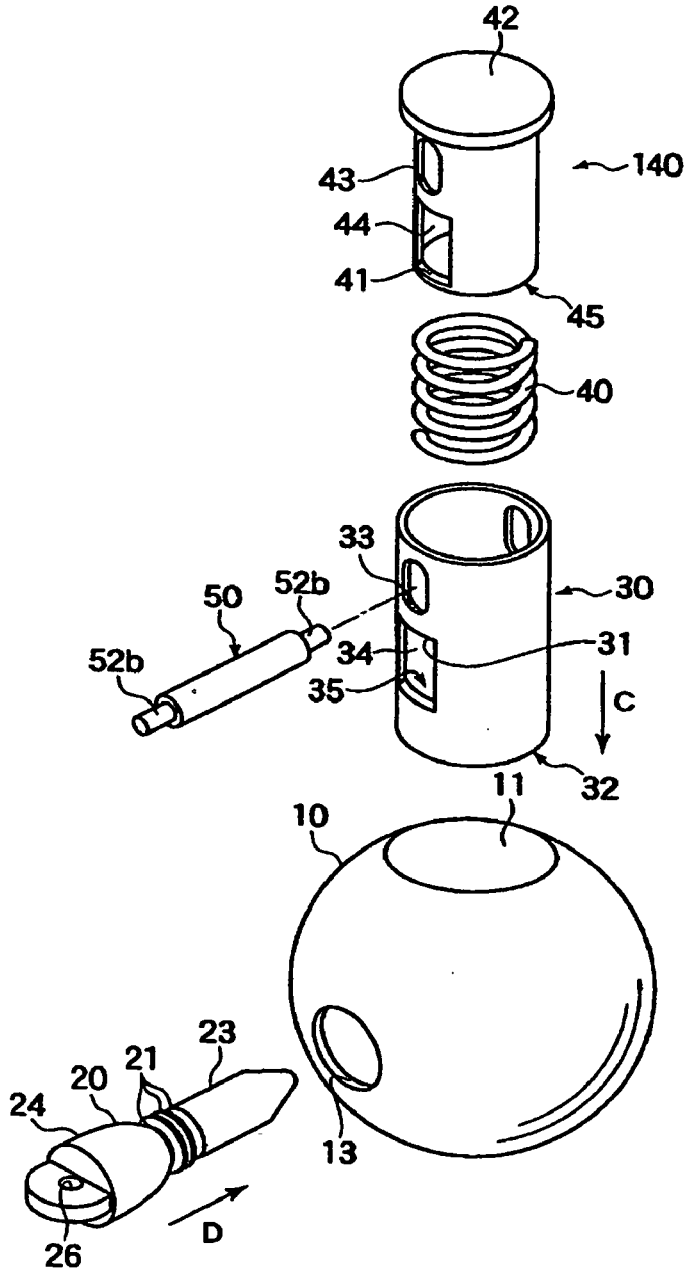
FIG. 9 is an exploded perspective view of the clasp in accordance with the fifth embodiment of the present invention.

FIG. 8 is a cross-sectional view of a clasp 500 in accordance with the fifth embodiment, and FIG. 9 is an exploded perspective view of the clasp 500. A horizontal positional relation in FIG. 9 is just opposite to FIG. 8.

As illustrated in FIGS. 8 and 9, the clasp 500 is comprised of a body 10, a pin 20 to be inserted into the body 10, a first stopper 31 and a second stopper 41 both engaging to the pin 20 having been inserted into the body 10 to keep the pin 20 engaged to the body 10, a first releaser 32 which ceases engagement of the first stopper 31 with the pin 20, and a second releaser 42 which ceases engagement of the second stopper 41 with the pin 20.

The first stopper 31 and the first releaser 32 are formed integrally with each other. Specifically, the first stopper 31 defines a part of a first cylinder 30, and the first releaser 32 also defines a part of the first cylinder 30. Similarly, the second stopper 41 and the second releaser 42 are formed integrally with each other. Specifically, the second stopper 41 defines a part of a second cylinder 140, and the second releaser 42 also defines a part of the second cylinder 140.

The clasp 500 further includes a coil spring 40 energizing the first and second cylinders 30 and 140, and a pin 50 (corresponding to "a single part" defined in claims) preventing the coil spring 40 and the first and second cylinders 30 and 140 from dropping out of the body 10.

The pin 50 has the same structure as the pin 50 used in the first embodiment, illustrated in FIG. 3.

As illustrated in FIGS. 8 and 9, at least a portion of the pin 20, to be inserted into the body 10, is formed cylindrical. In the fifth embodiment, the pin 20 is entirely in the form of a cylinder.

The pin 20 is formed at a circumference thereof with a plurality of grooves 21*a* to 21*c* to each of which the stopper 31 is engaged. For instance, the grooves 21*a* to 21*c* are formed to be an edge, and are arranged longitudinally of the pin 20.

In order to make the first and second stoppers 31 and 41 engaged to the pin 20, the first and second stoppers 31 and 41 are engaged to any two of the grooves 21*a* to 21*c*. This ensures it possible to control a length of a necklace to be connected to the clasp 500, in the directions D and G.

As illustrated in FIG. 8, a distal end 22 of the pin 20 is comprised of a planar end 22*b*, and a tapered portion 22*a* having a diameter gradually decreasing towards the planar end 22*b*. The tapered portion 22*a* guides the pin 20 to a predetermined position, when the pin 20 is inserted into the body 10. The planar end 22*b* of the pin 20 prevents a user from being injured, unlike a sharpened end.

The pin 20 includes a smaller-diameter portion 23 and a greater-diameter portion 24. The grooves 21*a* to 21*c* and the distal end 22 are formed at the smaller-diameter portion 23. The pin 20 is designed to include the greater-diameter portion 24 for a user to readily pinch the pin 20.

The greater-diameter portion 24 has an outer diameter which is equal to an outer diameter of the smaller-diameter portion 23 at the proximal end of the smaller-diameter portion 23, and which increases towards a proximal end of the pin 20.

The pin 20 is formed at a proximal end of the greater-diameter portion 24 with a connector ring 26 through which the pin 20 is connected with a necklace.

Each of the grooves 21*a* to 21*c* is inclined such that a diameter thereof increases towards the proximal end of the pin 20 from the distal end of the pin 20. A boundary between the adjacent grooves defines a step.

As illustrated in FIGS. 8 and 9, the first cylinder 30 is formed with a first hole 33 through which the pin 50 is inserted into the first cylinder 30, and a second hole 34 through which the smaller-diameter portion 23 of the pin 20 is inserted into the first cylinder 30. In addition, the first cylinder 30 includes, as well as the above-mentioned first stopper 31 and first releaser 32, a recess 35 in which the coil spring 40 is disposed, and a spring-force receiver 36 on which the coil spring 40 acts a resilient force.

The first cylinder 30 has a closed end, as illustrated in FIG. 8. The closed end of the first cylinder 30 defines the first releaser 32. The first releaser 32 has an arcuate surface continuous with an outer surface of the body 10. That is, the first releaser 32 has such shape and dimension that a surface thereof defines a part of a sphere having the same dimension as that of the body 10.

The first hole 33 through which the pin 50 is inserted extends perpendicularly to a longitudinal axis of the first cylinder 30. The first hole 33 is formed longer than a diameter of the cylinder 51 of the pin 50 in directions F and E indicated in FIG. 8 such that the first cylinder 30 can move in a direction in which the first stopper 31 is engaged to the pin 50 and in the opposite direction, that is, in the directions F and E, even when the pin 50 is inserted through the first cylinder 30. The first hole 33 is slightly longer than a diameter of the cylinder 51 of the pin 50 in a direction perpendicular to a plane defined by FIG. 8.

The second hole 34 through which the pin 20 is inserted extends perpendicularly to a longitudinal axis of the first cylinder 30. The first and second holes 33 and 34 extend in parallel with each other. Accordingly, the pin 20 and the pin 50 extend through the first cylinder 30 in parallel with each other. The second hole 34 is formed longer than a diameter of the smaller-diameter portion 23 of the pin 20 in the directions F and E such that the first cylinder 30 can move in the directions F and E, even when the pin 20 is inserted through the first cylinder 30, but is slightly longer than a diameter of the smaller-diameter portion 23 of the pin 20 in a direction perpendicular to a plane defined by FIG. 8.

The first stopper 31 is formed, among opposite openings of the second hole 34, at the opening closer to the hole 13.

Specifically, the first stopper 31 is formed on an inner edge of the opening located closer to the hole 13 such that the first stopper 31 faces the first releaser 32.

The first stopper 31 has an inclining surface facing the hole 13. The inclining surface guides the distal end 22 of the pin 20 into the second hole 34.

The second hole 34 is located closer to the first releaser 32 than the first hole 33.

The recess 35 is defined with an inner surface located closer to the first releaser 32 than the second hole 34. The recess 35 has an inner diameter slightly greater than an outer diameter of the coil spring 40.

The spring-force receiver 36 on which the coil spring 40 acts is defined with a bottom of the recess 35.

As illustrated in FIGS. 8 and 9, the second cylinder 140 is formed with a third hole 43 through which the pin 50 is inserted into the second cylinder 140, and a fourth hole 44 through which the smaller-diameter portion 23 of the pin 20 is inserted into the second cylinder 140. In addition, the second cylinder 140 includes, as well as the above-mentioned second stopper 41 and second releaser 42, a spring-force receiver 45 on which the coil spring 40 acts a resilient force.

The second cylinder 140 has a closed end, as illustrated in FIG. 8.

The second cylinder 140 has an outer diameter slightly smaller than an inner diameter of the first cylinder 30. Hence, the second cylinder 140 can be inserted through an opening end thereof into the first cylinder 30.

The closed end of the second cylinder 140 defines the second releaser 42. The second releaser 42 has an arcuate surface continuous with an outer surface of the body 10. That is, the second releaser 42 has such shape and dimension that a surface thereof defines a part of a sphere having the same dimension as that of the body 10. Specifically, the second releaser 42 is identical in shape and dimension to the first releaser 32.

The third hole 43 through which the pin 50 is inserted extends perpendicularly to a longitudinal axis of the second cylinder 140. The third hole 43 is formed longer than a diameter of the cylinder 51 of the pin 50 in directions F and E indicated in FIG. 8 such that the second cylinder 140 can move in a direction in which the second stopper 41 is engaged to the pin 50 and in the opposite direction, that is, in the directions F and E, even when the pin 50 is inserted through the second cylinder 140. The third hole 43 is slightly longer than a diameter of the cylinder 51 of the pin 50 in a direction perpendicular to a plane defined by FIG. 8.

The fourth hole 44 through which the pin 20 is inserted extends perpendicularly to a longitudinal axis of the second cylinder 140. The third and fourth holes 43 and 44 extend in parallel with each other. Accordingly, the pin 20 and the pin 50 extend through the first and second cylinders 30 and 40 in parallel with each other. The fourth hole 44 is formed longer than a diameter of the smaller-diameter portion 23 of the pin 20 in the directions F and E such that the second cylinder 140 can move in the directions F and E, even when the pin 20 is inserted through the second cylinder 140, but is slightly longer than a diameter of the smaller-diameter portion 23 of the pin 20 in a direction perpendicular to a plane defined by FIG. 8.

The second stopper 41 is formed, among opposite openings of the fourth hole 44, at the opening closer to the hole 13. Specifically, the second stopper 41 is formed on an inner edge of the opening located closer to the hole 13 such that the second stopper 41 faces the second releaser 42.

The second stopper 41 has an inclining surface facing the hole 13. The inclining surface guides the distal end 22 of the pin 20 into the fourth hole 44.

The fourth hole 44 is located remoter from the second releaser 42 than the third hole 43.

The spring-force receiver 45 receiving a force from the coil spring 40 is defined with an opening end of the second cylinder 140.

As illustrated in FIGS. 8 and 9, the body 10 is in the form of an elliptic cylinder. The body 10 is formed with a hole 11 in which the first cylinder 30, the second cylinder 140, the coil spring 40 and the pin 50 are arranged, and along which the first cylinder 30 is guided.

As mentioned later, the first cylinder 30, the second cylinder 140, the coil spring 40 and the pin 50 are inserted and arranged in the hole 11. The hole 11 is formed throughout the body 11.

In the body 10, a cylindrical wall 12 partially defining the hole 11 is formed integrally with the body 10.

The body 10 is formed with a hole 13 through which the pin 20 is inserted into the body 10. The hole 13 has a longitudinal axis in which the pin 20 is inserted into the body 10, and which is perpendicular to a direction in which the first and second cylinders 30 and 140 are inserted into the hole 11. A direction in which the pin 20 is inserted into the body 10 and a direction in which the first and second cylinders 30 and 140 are inserted into the hole 11 lie in a common plane.

The wall 12 is formed with a through-hole 12*a* facing the hole 13. The pin 20 inserted through the hole 13 passes through the through-hole 12*a*. The through-hole 12*a* is tapered at an end facing the hole 13. Specifically, the through-hole 12*a* has a tapered portion 12*b* having a greater diameter at a location closer to the hole 13. The tapered portion 12*b* guides the distal end 22 of the pin 20 into a center of the through-hole 12*a*.

The body 10 has a first internal space 18 formed between the wall 12 and the hole 13, and a second internal space 19 formed beyond the wall 12.

The wall 12 is formed with a pair of holes 14 and 15 for positioning the pin 50. Specifically, the second portions 52*b* of the pin 50 are positioned by the holes 14 and 15, and resultingly, the pin 50 is positioned in the body 10.

The holes 14 and 15 have an inner diameter slightly greater than an outer diameter of the second portion 52*b* of the pin 50.

The hole 15 leads to the hole 11 and the first internal space 18, and the hole 14 leads to the hole 11 and the second internal space 19.

The body 10 is formed at an outer surface thereof and at the opposite side to the hole 13 with a connector ring 16 through which a necklace is connected to the body 10. For instance, a necklace is connected at opposite ends thereof to the connector rings 16 and 26.

The coil spring 40 is comprised of a compressed coil spring.

The clasp 500 in accordance with the fifth embodiment is assembled as follows.

First, the coil spring 40 is inserted into the spring holder 35. Then, the second cylinder 140 is inserted through an opening end thereof into the first cylinder 30.

Then, the first and second cylinders 30 and 140 are positioned such that the first stopper 32 and the second stopper 42 face each other.

Then, the pin 50 is inserted into both the first hole 33 of the first cylinder 30 and the third hole 43 of the second cylinder 140.

At this stage, the first and second cylinders 30 and 140 are connected to each other through the pin 50. The coil spring 40 is sandwiched in the spring holder 35 between the spring-force receiver 36 of the first cylinder 30 and the spring-force receiver 45 of the second cylinder 40 in a compressed condition.

With the second portions 52*b* of the pin 50 being contracted, the first and second cylinders 30 and 140, the coil spring 40 and the pin 50 are inserted into the hole 11 in a direction indicated with an arrow C in FIG. 9.

When the pin 50 is inserted into the hole 11, the contracted second portions 52*b* are slid on an inner surface of the hole 11 until they reach the holes 14 and 15. When the second portions 52*b* reach the holes 14 and 15, the second portions 52*b* extend into the holes 14 and 15 by a force provided by the spring 53 disposed in the pin 50.

Thus, the parts except the pin 20 have been assembled to the clasp 500.

When the pin 50 is arranged in such a manner as illustrated in FIG. 8, since the second portions 52*b* of the pin 50 are positioned in the holes 14 and 15, the first and second cylinders 30 and 140, the coil spring 40 and the pin 50 do not fall off the body 10.

The first and second releasers 32 and 42 cooperate with the body 10 to define an outer surface of the clasp 500. In other words, the first and second releasers 32 and 42 are continuous with an outer surface of the body 10. Hence, a user would look at the clasp 500 as if the body 10 and the first and second releasers 32 and 42 define a ball.

An operation of the clasp 500 is explained hereinbelow.

First, the engagement of the first and second stoppers 31 and 41 with the pin 20 is explained hereinbelow.

First, with reference to FIG. 9, the pin 20 is inserted through the distal end 22 thereof into the hole 13 of the body 10 in the direction D. Even if the distal end 22 is out of a center of the through-hole 12*a*, the tapered portion 12*b* guides the distal end 22 to a center of the through-hole 12*a*.

When, after the distal end 22 of the pin 20 reached the first and second stoppers 31 and 41, the pin 20 is further inserted through the hole 12*a*, the first and second stoppers 31 and 41 are compressed by the tapered portion 22*a*. As a result, the first stopper 31 moves in the direction F against a spring force generated by the coil spring 40, and the second stopper 41 moves in the direction E against a spring force generated by the coil spring 40. Specifically, the first cylinder 30 moves in the direction F together with the first stopper 31, and the second cylinder 40 moves in the direction E together with the second stopper 41.

Thereafter, the pin 20 is further inserted deeply into the body 10. When the groove 21*a* reaches the first stopper 31, the first stopper 31 is energized by the coil spring 40 to move in the direction E. Thus, the first stopper 31 enters the groove 21*a*, that is, the first stopper 31 is engaged to the groove 21*a*. When the first stopper 31 moves, the first cylinder 30 also moves in the direction E.

When the pin 20 is further inserted deeply into the body 10, the first stopper 31 moves in the direction F along an inclined surface of the groove 21*a*, and accordingly, the first cylinder 30 moves in the direction F.

When the groove 21*b* reaches the first stopper 31, the first stopper 31 is engaged to the groove 21*b*. Almost at the same time, the groove 21*a* reaches the second stopper 41, and thus, the second stopper 41 is engaged to the groove 21*a*.

Thus, both the first and second stoppers 31 and 41 are engaged to the pin 20, resulting in that the pin 20 is kept not released from the body 10.

FIG. 8 illustrates a condition in which the pin 20 is further inserted into the body 10, and accordingly, the first stopper 31 is engaged to the groove 21*c*, and the second stopper 41 is engaged to the groove 21*b*.

Next, an operation for ceasing the engagement of the first and second stoppers 31 and 41 with the pin 20 is explained hereinbelow.

In order to release the pin 20 from the first and second stoppers 31 and 41, a user pinches the first and second releasers 32 and 42, and pushes them towards each other. Specifically, the engagement of the first and second stoppers 31 and 41 with the pin 20 can be ceased by pushing the first releaser 32 in the direction F, and pushing the second releaser 42 in the direction E both against a spring force provided by the coil spring 40.

By pushing the first releaser 32 in the direction F, the first stopper 31 is released from the groove (for instance, the groove 21*c*, as illustrated in FIG. 8), and by pushing the second releaser 42 in the direction E, the second stopper 41 is released from the groove (for instance, the groove 21*b*, as illustrated in FIG. 8). Thus, the engagement of the first and second stoppers 31 and 41 with the pin 20 is ceased.

Thereafter, the pin 20 can be pulled out of the body 10 in the direction G.

As mentioned above, in the clasp 500 in accordance with the fifth embodiment, it is possible to release the pin 20 from the first and second stoppers 31 and 41 by concurrently pushing the first and second releasers 32 and 42 towards each other.

An operation for exchanging a part of the clasp 500 into a new one is explained hereinbelow.

A part of the clasp 500 is exchanged to another part after the pin 20 was pulled out of the body 10.

While the pin 20 is pulled out of the body 10, a pin (not illustrated) is inserted into the hole 15 through the hole 13 and the first internal space 18. Then, one of the second portions 52*b* is contracted with a distal end of the pin. As a result, the end of the pin 50 at which the one of the second portions 52*b* is contracted moves in the direction F in FIG. 8 by a spring force provided by the coil spring 40, and accordingly, the pin 50 is inclined. The other second portion 52*b* is inclined in the hole 14.

By further pushing the first releaser 32 in the direction F, the pin 50 can be taken out of the hole 11 together with the first and second cylinders 30 and 140 and the coil spring 40. Thus, any one or more of the pin 50, the coil spring 40, the first cylinder 30, the second cylinder 140, and the body 10 may be replaced with a new one.

A part of the clasp 500 may be exchanged into a new one in the following way.

While the pin 20 is pulled out of the body 10, a pin (not illustrated) is inserted into the body 10 through the hole 13, and further into the hole 15 through the first internal space 18. Then, one of the second portions 52*b* is contracted with a distal end of the pin. Then, a J-shaped pin (not illustrated) is inserted into the body 10 through the hole 13, and further into the hole 14 through the first and second internal spaces 18 and 19. Then, the other second portion 52*b* is contracted with a distal end of the J-shaped pin.

As a result, the pin 50 moves in the direction F in FIG. 8 in accordance with a force provided by the coil spring 40. By further pushing the first releaser 32 in the direction F, the pin 50 as well as the first and second cylinders 30 and 140 and the coil spring 40 can be taken out.

In place of using the above-mentioned J-shaped pin, the body 10 may be formed at an outer surface of the second internal space 19 with a hole (not illustrated) in alignment with the hole 14, in which case, a pin is inserted into the hole 14 through the hole and the second internal space 19, and one of the second portions 52*b* is contracted with the pin.

In accordance with the above-mentioned fifth embodiment, the pin 20 is released from the first and second stoppers 31 and 41 by pushing the first and second stoppers 31 and 41 towards each other. Hence, a stroke by which the first releaser 32 has to move for releasing the pin 20 from the first stopper 31 can be shortened, and similarly, a stroke by which the second releaser 42 has to move for releasing the pin 20 from the second stopper 41 can be shortened. Thus, it is possible to minimize or delete a length by which the first and second releasers 32 and 42 project beyond the body 10.

For instance, it is possible to prevent the first and second releasers 32 and 42 from projecting beyond the body 10 by designing the body 10 to be spherical like the fifth embodiment. This ensures enhancement in appearance of the clasp 500.

In accordance with the above-mentioned fifth embodiment, since the first cylinder 30, the second cylinder 140 and the coil spring 40 are arranged in the body 10 by means of the single pin 50, it would be possible to fabricate the clasp 500 with the small number of parts, readily assemble the clasp 500, and readily replace a part of the clasp 500 with a new one.

Furthermore, since the pin 50 is hidden in the body 10, and cannot be seen from outside of the body 10. Hence, the clasp 500 can have good appearance.

Furthermore, since the pin 20 has a plurality of the grooves 21*a* to 21*c*, it would be possible to vary a length of a necklace connected to the clasp 500.

It would be possible to control a length of the pin 20 projecting outwardly beyond the body 10. Thus, among a plurality of the bodies 10 having different lengths between the first or second stopper 31 or 41 and the hole 13, a preferable one can be selected.

Though the body 10 in the fifth embodiment is in the form of a ball, the body 10 may be in any form. For instance, the body 10 may be rectangular parallelepiped or elliptically cylindrical.

A critical strength at which the pin 20 is released from the first and second stoppers 31 and 41 when the pin 20 is pulled in the direction G is determined in dependence on an angle and a height of the grooves 21*a* to 21*c*, and a strength of the coil spring 40.

Though the pin 20 is designed to have the three grooves 21*a* to 21*c*, it should be noted that the pin 20 may be designed to have two, or four or more grooves.

[Sixth Embodiment]

Figure 10:
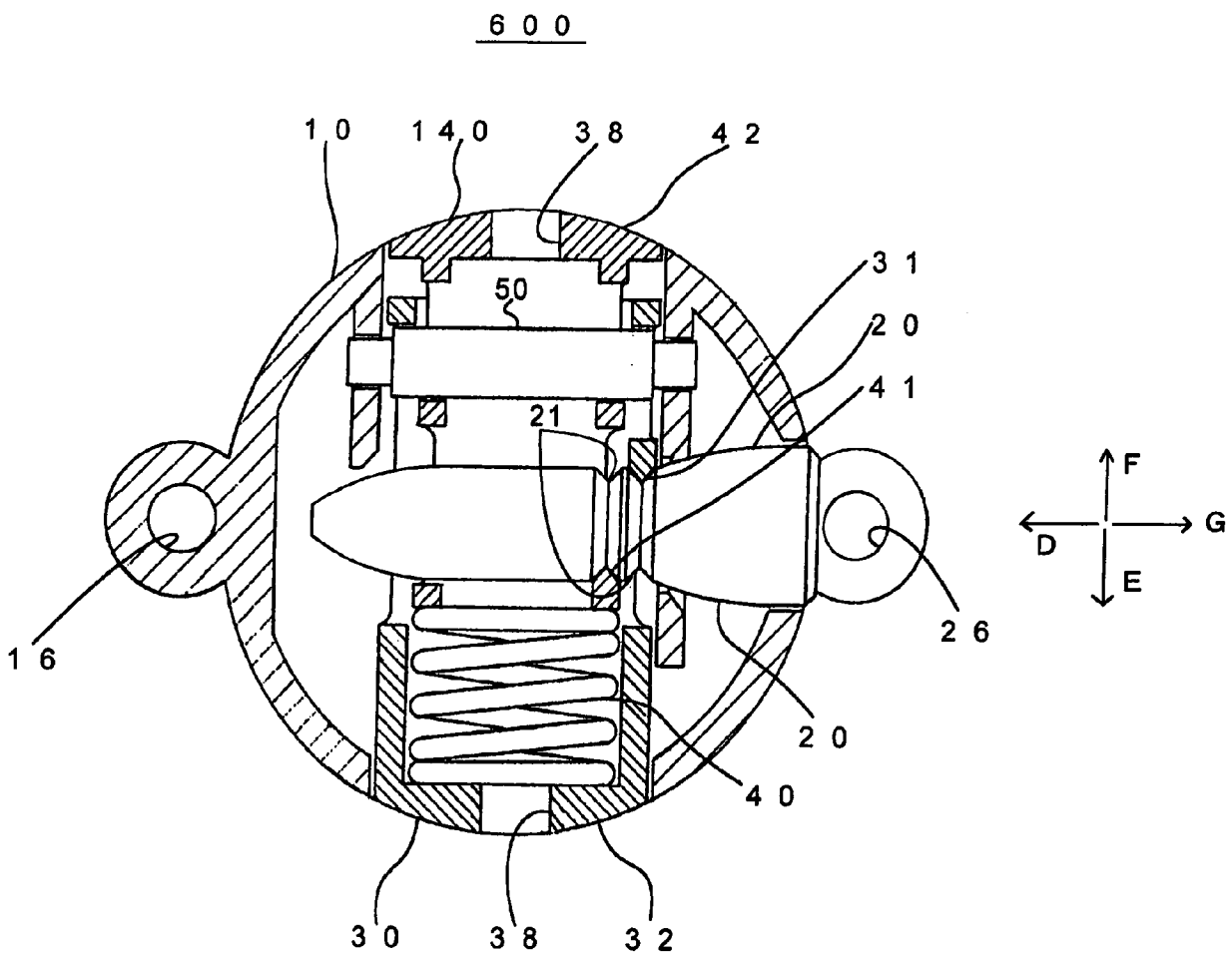
FIG. 10 is a cross-sectional view of the clasp in accordance with the sixth embodiment of the present invention.

FIG. 10 is a cross-sectional view of a clasp 600 in accordance with the sixth embodiment of the present invention.

Hereinbelow is explained the clasp 600 with reference to FIG. 10.

The clasp 600 is structurally different from the clasp 500 in accordance with the fifth embodiment only in a number of the grooves, a shape of the grooves, a shape of the first and second stoppers 31 and 41, and a structure of the first and second releasers 32 and 42. Hence, parts or elements that correspond to clasp 500 have been provided with the same reference numerals, and are not explained.

As illustrated in FIG. 10, the pin 20 in the sixth embodiment has two grooves 21.

The grooves 21 illustrated in FIG. 10 are in the form of a valley, or V-shaped. In other words, each of the V-shaped grooves 21 has a diameter increasing both towards the distal end 22 of the pin 20 and towards a proximal end of the pin 20 from a bottom of the valley.

In accordance with the valley shape of the grooves 21, the first and second stoppers 31 and 41 are in the form of a mountain, or reverse-V-shaped.

Hence, when the pin 20 is inserted into the hole 13 in the direction D, the first and second stoppers 31 and 41 are readily engaged to the grooves 21, and are released from the grooves 21 when the pin 20 is strongly pulled in the direction G. This is because, if the first and second stoppers 31 and 41 are strongly engaged to the grooves 21, a user may be choked with a necklace connected to the clasp 600. Such a problem can be solved by designing the first and second stoppers 31 and 41 to be released from the grooves 21 when a force having certain strength acts on the pin 20.

The V-shaped grooves 21 and the reverse-V-shaped stoppers 31 and 41 may be applied to the above-mentioned first to fifth embodiments.

The first and second releasers 32 and 42 may be formed with a hole 38 through which a sound generated when the first and second releasers 32 and 42 are engaged to the pin 20 is emitted out of the body 10. The hole 38 is formed throughout the first and second releasers 32 and 42.

A sound generated when the first and second releasers 32 and 42 are engaged to the pin 20 reaches a user through the hole 38, ensuring a user to check whether the pin 20 is surely engaged to the body 10.

The hole 38 may be formed at one of the first and second releasers 32 and 42. As an alternative, the hole 38 may be formed at the body 10.

[Seventh Embodiment]

Figure 11:
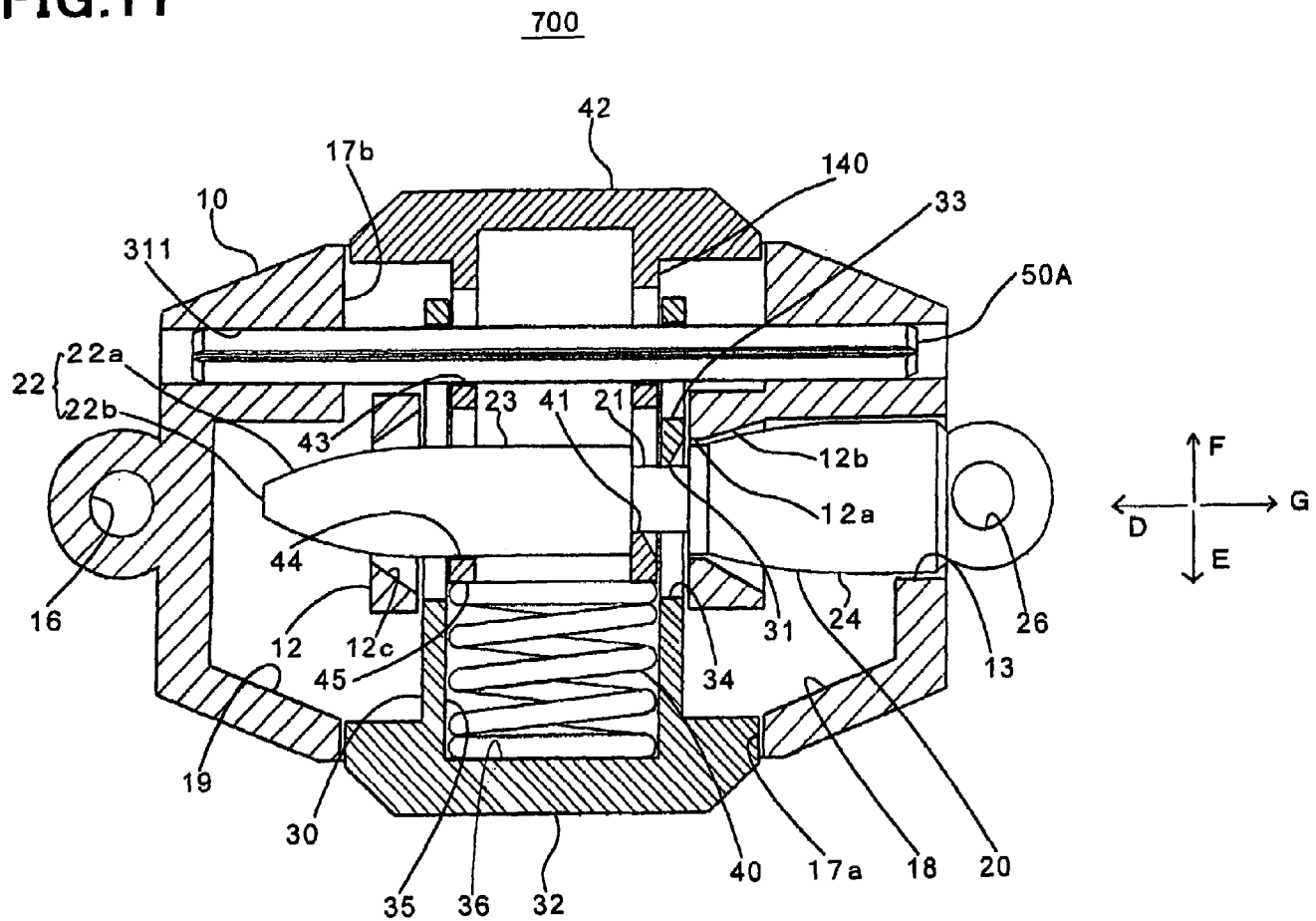
FIG. 11 is a cross-sectional view of the clasp in accordance with the seventh embodiment of the present invention.

FIG. 11 is a cross-sectional view of a clasp 700 in accordance with the seventh embodiment of the present invention.

Hereinbelow is explained the clasp 700 with reference to FIG. 11.

The clasp 700 is structurally different from the clasp 500 in accordance with the fifth embodiment only in what is explained later. Hence, parts or elements that correspond to clasp 500 have been provided with the same reference numerals, and are not explained.

Figure 12:
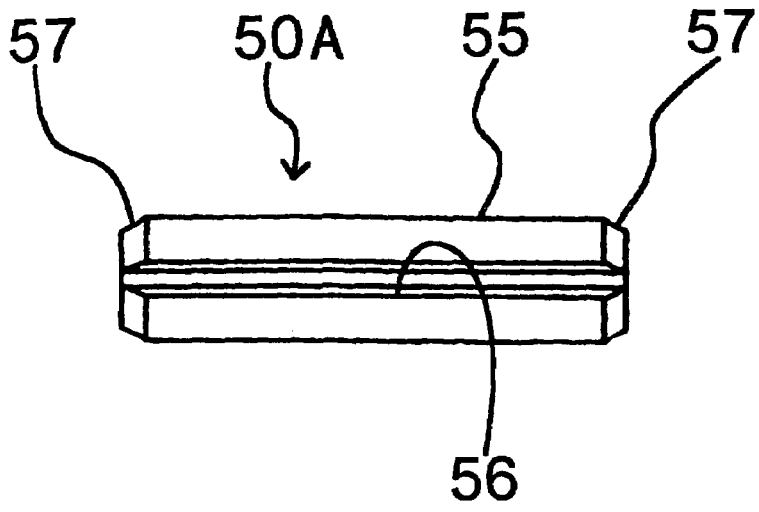
FIG. 12 is a planar view of a pin used in the clasp in accordance with the seventh embodiment of the present invention.

Whereas the clasp 500 in accordance with the fifth embodiment uses the pin 50 illustrated in FIG. 3, the clasp 700 uses such a spring pin 50A as illustrated in FIG. 12 in place of the pin 50.

The pin 50A illustrated in FIG. 12 is comprised of a cylindrical body 55 formed with a cut-out 56 extending longitudinally thereof The cylindrical body 55 has chamfered ends 57 so as to be thin at opposite ends.

The pin 50A is fixedly inserted into a hole (for instance, a later mentioned hole 311), if the hole has a diameter almost equal to or slightly smaller than a diameter of the cylindrical body 55. The chamfered ends 57 facilitate the pin 50A to be inserted into such a hole.

The body 10 in the clasp 700 has a polygonal cross-section such as an octagonal cross-section as illustrated in FIG. 11. However, it should be noted that it is not always necessary for the body 10 to be octagonal in cross-section, but the body 10 may be in any form.

The body 10 is formed with a hole 311 therethrough in place of the holes 14 and 15. The pin 50A is inserted into the hole 311. The hole 311 extends in parallel with a direction in which the pin 20 is inserted into the body 10.

The first and second releasers 32 and 42 in the seventh embodiment are designed flat in harmony with an outer shape of the body 10.

The body 10 in the seventh embodiment is formed with a first hole 17*a* and a second hole 17*b* in place of the hole 11 in the fifth embodiment. The first cylinder 30 is positioned in the first hole 17*a*, and the second cylinder 140 is positioned in the second hole 17*b*. The first and second holes 17*a* and 17*b* face each other, and lead to each other in the body 10 through a wall 12.

The wall 12 is formed at a surface facing the second internal space 19 with a through-hole 12*c* through which the pin 20 is introduced into the second internal space 19. The through-hole 12*c* is tapered similarly to the above-mentioned tapered portion 12*b*.

The pin 20 in the seventh embodiment is formed with a single groove 21. The groove 21 has a diameter smaller than the smaller-diameter portion 23 of the pin 20. The first and second stoppers 31 and 41 are concurrently engaged to the groove 21.

The clasp 700 in accordance with the seventh embodiment is fabricated as follows.

The coil spring 40 is inserted into the recess 35 of the first cylinder 30.

Then, the first cylinder 30 is inserted through an opening end thereof into the first hole 17*a*. The second cylinder 140 is inserted through an opening end thereof into the second hole 17*b*, and then, inserted into the first cylinder 30.

Then, the first and second cylinders 30 and 140 are rotated such that the first and second releasers 32 and 42 face the hole 13.

Then, the first and second releasers 32 and 42 are pushed towards each other to thereby relatively position the first cylinder 30, the second cylinder 140 and the body 10 as illustrated in FIG. 11.

Then, the pin 50A is inserted into the hole 311 until the pin 50A reaches a position illustrated in FIG. 11.

Ceasing pushing the first and second releasers 32 and 42, the first cylinder 30, the second cylinder 140 and the coil spring 40 are positioned as illustrated in FIG. 11.

As illustrated in FIG. 11, after the pin 50A has been inserted into the hole 311, the pin 50A is fixed in the hole 311. Furthermore, the first and second cylinders 30 and 140 are connected to each other through the pin 50A, and are fixed to the body 10 through the pin 50A. Hence, the first cylinder 30, the second cylinder 140 and the body 10 do not fall off the body 10.

In FIG. 11, the coil spring 40 is sandwiched in the recess 35 between the spring-force receiver 36 of the first cylinder 30 and the spring-force receiver 35 of the second cylinder 140 in a compressed condition.

An operation of the clasp 700 is explained hereinbelow.

First, the engagement of the first and second stoppers 31 and 41 with the pin 20 is explained hereinbelow.

First, the pin 20 is inserted through the distal end 22 thereof into the hole 13 of the body 10 in the direction D in FIG. 11.

When, after the distal end 22 of the pin 20 reached the first and second stoppers 31 and 41, the pin 20 is further inserted, the first and second stoppers 31 and 41 are compressed by the tapered portion 22*a* of the pin 20. As a result, the first stopper 31 moves in the direction F against a spring force generated by the coil spring 40, and the second stopper 41 moves in the direction E against a spring force generated by the coil spring 40.

Thereafter, the pin 20 is further inserted deeply into the body 10. When the groove 21 reaches the first stopper 31, the first stopper 31 is energized by the coil spring 40 to move in the direction E. Thus, the first stopper 31 enters the groove 21, that is, the first stopper 31 is engaged to the groove 21.

Then, the pin 20 is further inserted deeply into the body 10. When the groove 21 reaches the second stopper 41, the second stopper 41 is energized by the coil spring 40 to move in the direction F. Thus, the second stopper 41 enters the groove 21, that is, the second stopper 41 is engaged to the groove 21.

Thus, both the first and second stoppers 31 and 41 are engaged to the groove 21 of the pin 20, and resultingly, the pin 20 is not released from the body 10.

The pin 20 is released from the first and second stoppers 31 and 41 in the same way as the fifth embodiment.

A part of the clasp 700 can be exchanged into another one by strongly inserting a pin (not illustrated) into the hole 311 for pushing the pin 50A out of the hole 311.

The clasp 700 in accordance with the seventh embodiment provides the same advantages as those provided by the clasp 500. Furthermore, since the clasp 700 uses the pin 50A illustrated in FIG. 12, the clasp 700 can be assembled more readily than the clasp 500.

The pin 20 in the seventh embodiment may be designed to have a plurality of the grooves 21. At least one of the first releaser 32, the second releaser 42 and the body 10 may be formed with the above-mentioned hole 38 through which a sound generated when the first and second stoppers 31 and 41 are engaged to the pin 20 is emitted out of the body 10. The groove 21 illustrated in FIG. 11 may be applied to the clasp 500 in accordance with the fifth embodiment.

[Eighth Embodiment]

Figure 13:
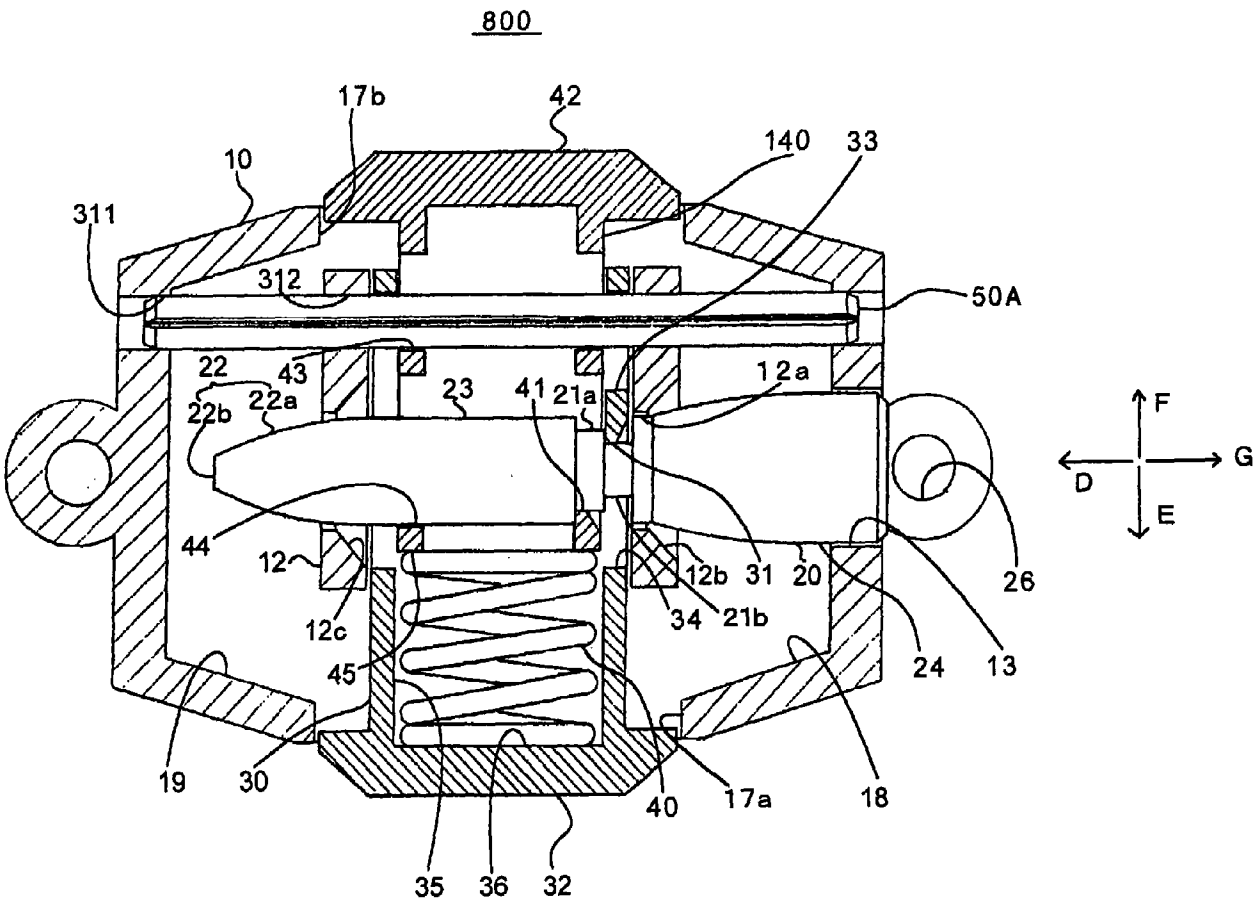
FIG. 13 is a cross-sectional view of the clasp in accordance with the eighth embodiment of the present invention.

FIG. 13 is a cross-sectional view of a clasp 800 in accordance with the eighth embodiment of the present invention.

Hereinbelow is explained the clasp 800 with reference to FIG. 13.

The clasp 800 is structurally different from the clasp 700 in accordance with the seventh embodiment only in the groove 21 and the wall 12. Hence, parts or elements that correspond to clasp 700 have been provided with the same reference numerals, and are not explained.

As illustrated in FIG. 13, the groove in the eighth embodiment is comprised of a first groove 21*a* located closer to the distal end 22 of the pin, and a second groove 21*b* located remoter from the distal end 22 of the pin 20. The first groove 21*a* has a diameter greater than a diameter of the second groove 21*b*.

The wall 12 is formed with a hole 312 into which the pin 50A is inserted. The pin 50A is fixed to the wall 12. Hence, the body 10 could have a thinner outer shell at which the hole 311 is formed, than that of the body 10 in the clasp 700 illustrated in FIG. 11.

At least one of the first releaser 32, the second releaser 42 and the body 10 may be formed with the above-mentioned hole 38 through which a sound generated when the first and second stoppers 31 and 41 are engaged to the pin 20 is emitted out of the body 10.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Applications Nos. 2004-046777 and 2004-046778 both filed on Feb. 23, 2004 including specification, claims, drawings and summary is incorporated herein by reference in its entirety.

What is claimed is:

1. A clasp for jewelry, comprising:

a body;

a pin insertable into said body;

a stopper engaging said pin having been inserted into said body to keep said pin engaged to said body;

a releaser releasing said pin from said body, wherein said releaser and said stopper are arranged to said body through a single part disposed in said body; and a cylinder to which said stopper and said releaser are integrally formed, said cylinder being movable relative to said body, wherein said releaser and said stopper are arranged to said body through a single part disposed in said body, wherein said single part passes through said cylinder, said cylinder being inserted into said body, in a direction intersecting with a direction in which said cylinder is inserted into said body, and wherein said single part is supported at opposite ends of said single part by said body to prevent said single part and said cylinder from releasing from said body.

2. The clasp as set forth in claim 1, wherein said pin comprises at least one groove through which said stopper is engaged to said pin.

3. The clasp as set forth in claim 1, wherein said releaser and said stopper are detachably arranged to said body through said single part.

4. The clasp as set forth in claim 1, wherein said single part includes a spring therein, and at least one end of said single part is slidable against said spring, and wherein said single part and said cylinder can be released from said body by sliding said one end of said single part.

5. The clasp as set forth in claim 1, wherein said single part is comprised of a pin.

6. The clasp as set forth in claim 1, further comprising a coil spring energizing said cylinder in a direction in which said stopper engages to said pin, said coil spring being arranged around said cylinder and being arranged in said body through said single part.

7. The clasp as set forth in claim 1, further comprising a surface-defining part separated from said body and cooperating with said body to define an outer surface of said clasp, said surface-defining part having a portion defining said outer surface of said clasp, said portion being ornamented differently from an outer surface of said body.

8. The clasp as set forth in claim 7, wherein said surface-defining part is attached to said body through said single part.

9. The clasp as set forth in claim 7, wherein said surface-defining part defines an outer surface of an end located oppositely to said releaser.

10. The clasp as set forth in claim 1, wherein said releaser is comprised of a first releaser and a second releaser, said pin being released from said stopper by compressing said first and second releasers towards each other.

11. The clasp as set forth in claim 10, wherein said pin comprises at least one groove through which said stopper is engaged to said pin.

12. The clasp as set forth in claim 10, wherein said stopper is comprised of a first stopper and a second stopper, said first stopper being released from said pin by means of said first releaser and said second stopper being released from said pin by means of said second releaser.

13. The clasp as set forth in claim 12, wherein said first and second stoppers are engaged to said pin so as to sandwich said pin therebetween.

14. The clasp as set forth in claim 12, further comprising:

a first cylinder to which said first stopper and said first releaser are integrally formed; and a second cylinder to which said second stopper and said second releaser are integrally formed, said first and second cylinders being movable relative to said body.

15. The clasp as set forth in claim 14, further comprising a spring.

16. The clasp as set forth in claim 15, wherein said first and second cylinders and said spring are prevented from dropping off said body by means of said single part.

17. The clasp as set forth in claim 14, wherein at least one of said body, said first cylinder, and said second cylinder comprises a hole through which a sound generated when at least one of said first stopper and said second stopper is engaged to said pin is emitted out of said clasp.

18. The clasp as set forth in claim 10, wherein said first and second releasers partially define an outer surface of said body.

* * * * *